US010350477B2

(12) United States Patent
Schneider

(10) Patent No.: US 10,350,477 B2
(45) Date of Patent: Jul. 16, 2019

(54) SPORTS EQUIPMENT THAT EMPLOY FORCE-ABSORBING ELEMENTS

(71) Applicant: Composite Technology Concepts, LLC, Tacoma, WA (US)

(72) Inventor: Terrence Lee Schneider, Puyallup, WA (US)

(73) Assignee: Composite Technology Concepts, LLC, Tacoma, WA (US)

( * ) Notice: Subject to any disclaimer, the term of this patent is extended or adjusted under 35 U.S.C. 154(b) by 298 days.

(21) Appl. No.: 14/490,123

(22) Filed: Sep. 18, 2014

(65) Prior Publication Data

US 2015/0107005 A1 Apr. 23, 2015

Related U.S. Application Data

(60) Provisional application No. 61/892,977, filed on Oct. 18, 2013.

(51) Int. Cl.
*A63C 5/07* (2006.01)
*A42B 3/06* (2006.01)
(Continued)

(52) U.S. Cl.
CPC ..... *A63C 5/07* (2013.01); *A42B 3/065* (2013.01); *A42B 3/124* (2013.01); *A63C 5/126* (2013.01);
(Continued)

(58) Field of Classification Search
CPC ..... A41D 2600/10; A42B 3/12; A42B 3/125; A42B 3/127; A42B 3/128; A42B 3/069; A42B 3/068; A42B 3/065; A63B 71/10
(Continued)

(56) References Cited

U.S. PATENT DOCUMENTS 41,974 A * 3/1864 Class
2,768,919 A * 10/1956 Bjorksten ..... A42B 3/065 2/2.5
(Continued)

FOREIGN PATENT DOCUMENTS

WO WO 8603383 A1 * 6/1986 ..... A42B 3/065
WO WO 2006089235 A1 * 8/2006
WO 2012045169 A1 4/2012

OTHER PUBLICATIONS

Steinberg, L., "New Helmet Technology Promises Concussion Relief," http://www.forbes.com/sites/leighsteinberg/2014/12/07/breakthrough-helmet-technology-offers-concussion-relief/print/, Forbes.com LLC, Dec. 7, 2014, Accessed Dec. 8, 2014 (2 pages).
(Continued)

*Primary Examiner* — Alissa L Hoey
(74) *Attorney, Agent, or Firm* — Conley Rose, P.C.; Grant Rodolph; Brooks W Taylor

(57) ABSTRACT

Embodiments are directed towards a helmet adapted for use by a human being for a variety of activities. The helmet includes a shell, a plurality of FAEs, and at least one rigid component. The shell maybe configured and arranged to cover a portion of a wearer's head. The plurality of FAEs may be separately positioned adjacent to the shell's interior surface. Each FAE may include at least one disc spring that is adapted for absorbing forces. The at least one rigid component may be disposed within the shell and adjacent to the plurality of FAEs. In this way, the FAEs may be between the shell's interior surface and the at least one rigid component. When a force is applied to a location on the shell's exterior surface, it may be substantially absorbed by at least one of the FAEs positioned adjacent to the location on the shell's interior surface.

6 Claims, 21 Drawing Sheets

(51) Int. Cl.

| | |
|---|---|
| ***A42B 3/12*** | (2006.01) |
| ***A63C 5/12*** | (2006.01) |
| ***A63C 17/00*** | (2006.01) |
| ***A63C 17/01*** | (2006.01) |
| *A63B 71/12* | (2006.01) |
| *A63C 5/03* | (2006.01) |

(52) U.S. Cl.
CPC ..... *A63C 17/0046* (2013.01); *A63C 17/015* (2013.01); *A63B 71/12* (2013.01); *A63B 2071/125* (2013.01); *A63B 2071/1258* (2013.01); *A63C 5/03* (2013.01); *A63C 2203/42* (2013.01)

(58) Field of Classification Search
USPC ..... 2/6.8, 411, 414, 425
See application file for complete search history.

(56) References Cited

U.S. PATENT DOCUMENTS 3,029,071 A * 4/1962 Wells ..... F16B 43/00 267/161
3,231,454 A * 1/1966 Williams ..... B65D 81/03 206/521
3,489,402 A * 1/1970 Cobley ..... F16F 3/12 267/152
3,876,492 A * 4/1975 Schott ..... E04C 2/3405 244/117 R
3,877,076 A * 4/1975 Summers ..... A42B 3/124 2/414
4,032,127 A * 6/1977 Lipfert ..... 267/151
4,354,284 A 10/1982 Gooding
5,204,998 A * 4/1993 Liu ..... 2/411
5,518,802 A * 5/1996 Colvin ..... B32B 3/12 428/166
5,713,082 A * 2/1998 Bassette et al. ..... 2/412
5,950,244 A * 9/1999 Fournier et al. ..... 2/414
6,682,128 B2 * 1/2004 Carroll ..... A62B 1/22 188/371
7,089,690 B2 * 8/2006 Krstic ..... A43B 3/0042 36/141
7,404,593 B2 * 7/2008 Cormier ..... A62B 1/22 188/371
7,673,351 B2 * 3/2010 Copeland et al. ..... 2/425
7,904,971 B2 * 3/2011 Doria et al. ..... 2/412
7,950,073 B2 * 5/2011 Ferrara ..... 2/417
8,739,317 B2 * 6/2014 Abernethy ..... 2/413
8,998,298 B2 * 4/2015 Gerwolls ..... F16F 7/128 188/377
9,089,180 B2 * 7/2015 Phipps ..... A42B 3/12
9,194,136 B2 * 11/2015 Cormier ..... E04F 15/225
9,314,062 B2 * 4/2016 Marz ..... A42B 3/12
9,326,561 B2 * 5/2016 Erb ..... A42B 3/20
2006/0059606 A1 * 3/2006 Ferrara ..... A01N 25/18 2/412
2006/0070170 A1 * 4/2006 Copeland ..... A41D 31/0044 2/411
2007/0056081 A1 3/2007 Aspray
2008/0009556 A1 * 1/2008 Schneider et al. ..... 521/128
2008/0256686 A1 * 10/2008 Ferrara ..... A41D 13/0155 2/413
2009/0222964 A1 * 9/2009 Wiles ..... 2/6.6
2010/0186150 A1 * 7/2010 Ferrara et al. ..... 2/412
2010/0244469 A1 * 9/2010 Gerwolls ..... F16F 7/12 293/120
2010/0299812 A1 * 12/2010 Maddux ..... A42B 3/124 2/414
2011/0047678 A1 * 3/2011 Barth ..... A42B 3/124 2/411
2011/0296594 A1 12/2011 Thomas et al.
2012/0036620 A1 * 2/2012 Harris ..... 2/414
2012/0124718 A1 * 5/2012 Picotte ..... 2/413
2012/0180200 A1 * 7/2012 Gaudet ..... 2/411
2013/0000015 A1 * 1/2013 Marzec et al. ..... 2/411
2013/0000020 A1 * 1/2013 Frederick ..... 2/455
2013/0086733 A1 * 4/2013 Szalkowski et al. ..... 2/414
2013/0125294 A1 * 5/2013 Ferrara ..... 2/411
2013/0153350 A1 6/2013 Ferrara et al.
2013/0247284 A1 9/2013 Hoshizaki et al.
2013/0291289 A1 * 11/2013 Szalkowski et al. ..... 2/414
2014/0013491 A1 * 1/2014 Hoshizaki et al. ..... 2/411
2014/0196198 A1 * 7/2014 Cohen ..... 2/414
2014/0201890 A1 * 7/2014 Kelly et al. ..... 2/413
2014/0325745 A1 * 11/2014 Erb et al. ..... 2/414

OTHER PUBLICATIONS

International Search Report and Written Opinion for International Application No. PCT/US2014/056394 dated Dec. 24, 2014 (11 pages).
Riddell SpeedFlex Helmet. http://www.riddell.com/shop/on-field-equipment/helmets/riddell-speedflex-helmet, html#protection-tab. Accessed Jan. 20, 2015 (2 pages).
Avila, J. et al. "Riddell Unveils Overhauled New Football Helmet SpeedFlex." https://gma.yahoo.com/riddell-unveils-overhauled-football-helmet-speedflex-124524183--abc-news-wellness.html?soc_src=mediacontentsharebuttons. Good Morning America, Aug. 27, 2014, Accessed Aug. 27, 2014 (3 pages).
Bagavathiperumal., P., et al. "Elastic load-displacement predictions for coned disc springs subjected to axial loading using the finite element method." The Journal of Strain Analysis for Engineering Design, 26, 3, Jul. 1, 1991, 147-152.
Karakaya S., "Investigation of hybrid and different cross-section composite disc springs using finite element method," Transactions of the Canadian Society for Mechanical Engineering, 36, 4, Dec. 1, 2012, 399-412.
Dharan, C. K. H., et al., "Composite disc springs." Composites Part A, 38, 12, Dec. 1, 2007, 2511-2516.
Almen, J. O., et al., "The Uniform-Section Disc Spring," Transactions of the ASME , vol. 58, 1936, 305-14.
Pedersen, N. L. et al., "Stiffness and Design for Strength of Trapezoidal Belleville Springs." Journal of Strain Analysis for Engineering Design, vol. 46, No. 8, 2011, 825-836.
Belleville washer, http://en.wikipedia.org/wiki/Belleville_washer, Aug. 2004. Accessed Sep. 30, 2014 (4 pages).
Dean, J., "How Reebok is Tackling One of the Sports World's Trickiest Problems." http://www.fastcodesign.com/3035264/innovation-by-design-2014/reebok-heads-off-injury, FAST Company, Sep. 2014, Accessed Oct. 1, 2014 (10 pages).
MC10 Inc., http://www.mc10inc.com/consumer-products/sports/checklight/, Accessed Oct. 1, 2014 (7 pages).

* cited by examiner

SPORTS EQUIPMENT THAT EMPLOY FORCE-ABSORBING ELEMENTS

CROSS REFERENCE TO RELATED APPLICATIONS

This non-provisional patent application claims the benefit under 35 U.S.C. § 119(e) of U.S. Provisional Patent Application Ser. No. 61/892,977 filed on Oct. 18, 2013, entitled "Shock Absorbing Element," which is incorporated herein by reference.

TECHNICAL FIELD

The present invention relates generally to a light-weight, elastic, high spring force, shock-absorbing element with deformable features able to absorb and reduce a wide range of loads associated with sudden impact forces while operating within a confined or compact space.

BACKGROUND

Many different types of sports equipment try to reduce the impact felt by a participant. Such sports equipment may include helmets, elbow pads, shoulder pads, chest pads, shin guards, body armor, or other damper-like devices. These devices aim to reduce the shock or force affecting a wearer to reduce possible injuries caused by the initial force. However, many conventional padding systems are designed to take high impact forces or low impact forces, but not both. Similarly, foam systems are generally limited in effectiveness since once they deform to their load/deflection limit they are no longer capable of absorbing forces which exceed this load/deflection limit. Thus, it is with respect to these considerations and others that the invention has been made.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, wherein.

DETAILED DESCRIPTION

Figure 1A:
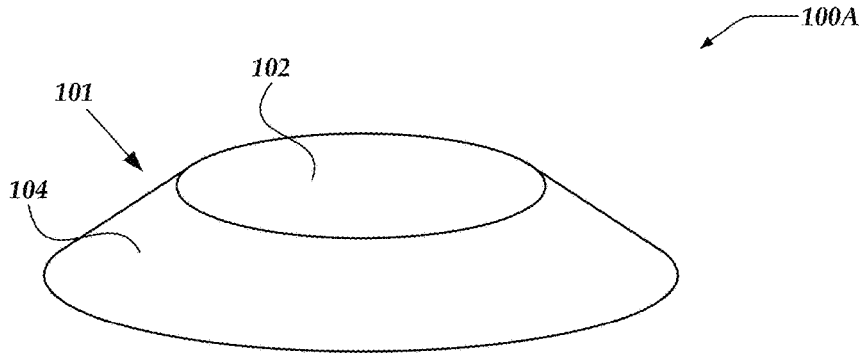
FIGS. 1A and 1B show schematic perspective views of a force-absorbing element in accordance with at least one of the various embodiments.

Various embodiments are described more fully hereinafter with reference to the accompanying drawings, which form a part hereof, and which show, by way of illustration, specific embodiments by which the invention may be practiced. The embodiments may, however, be embodied in many different forms and should not be construed as limited to the embodiments set forth herein; rather, these embodiments are provided so that this disclosure will be thorough and complete, and will fully convey the scope of the embodiments to those skilled in the art. The following detailed description should, therefore, not be limiting.

Throughout the specification and claims, the following terms take the meanings explicitly associated herein, unless the context clearly dictates otherwise. The term "herein" refers to the specification, claims, and drawings associated with the current application. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, the term "force-absorbing element" or "FAE" refers to an arrangement and configuration of one or more disc springs and an elastomer element. In some embodiments, a disc spring may be a conventional conical washer, such as a Belleville washer. In various embodiments, the disc spring may have a frusto-conical exterior with a planar top surface connected to a skirt, such that the skirt creates an aperture under the planar top surface. In various embodiments, the planar top surface may be a plate, an aperture (e.g., circular or other shaped hole), or a plate with an aperture.

As used herein, the term "elastomeric component" or "elastomeric connector" may refer to a device that can orient or align multiple disc springs together in a force-absorbing element, or a device that can connect one or more disc springs to separate surface, or a device that has force-absorbing capability to absorb forces less than or equal to the force-absorbing threshold of the disc spring. In various embodiments, the elastomeric component may be made of an elastomeric material or low modulus polymeric material. In various embodiments, the elastomeric component may include a base with a central protrusion having at the opposite end a flanged rim. The base and/or flanged rim may have an outside diameter that is greater than a diameter of an aperture on the top planar surface of a disc spring, so as to retain the disc spring on the central protrusion.

FIG. 1A shows a schematic perspective view of a force-absorbing element in accordance with at least one of the various embodiments. FIG. 1A shows an opaque view of FAE 100A. FAE 100A may be a single disc spring, such as disc spring 101, which may include top 102 and skirt 104, such that skirt 104 is connected to top 102 to create a frusto-conical shape.

In some embodiments, disc spring 101 may be a convention disc spring, such as a Belleville washer, which is further illustrated below in FIG. 1E. Conical disc springs are axial compression springs made to special geometrical relationships of overall height, diameter, thickness, and interior height. Their spring performance depends on their conical height, thickness, and the applied deflection. Disc springs may be used singly or in stacks to functionally react to specific ranges of loads and deflections depending on the application in which they are used.

Disc springs exhibit several unique advantages relative to conventional helical compression springs. In particular, key advantages include, but are not limited to: 1) disc springs provide a high spring force with low deflection in a very compact envelope; 2) disc springs have a high service life under dynamic, cyclical loading conditions; 3) disc springs provide high damping of forces especially when stacked in a parallel; 4) disc springs enable a variety of load-deflection performance curves (linear, regressive, or progressive), depending on the application, by stacking discs in various configurations; and 5) discs of different geometries (spring force) can be combined to provide multi-stage load-deflection performance curves.

Briefly, an FAE may include at least one conically-shaped disc spring (e.g., a composite disc spring). The geometry of the disc spring may include a symmetrical skirt with a top that is perpendicular to the center axis of symmetry of the skirt and perpendicular to the direction of compression. The top may be a solid planar surface (e.g., top 102 of FIG. 1A), a planar surface with an aperture (e.g., top 510 of FIG. 5), or an aperture top (e.g., top 142 of FIG. 1E). In some embodiments, the top may be used to join the FAE to a surface. The FAE may become functional once joined to a surface at its top and the disc's cone (e.g., ring 114 of FIGS. 1B and 1C) positioned either in contact with or is in proximity to an opposing planar surface or curved surface, perpendicular to the central, symmetrical axis of the disc (e.g., as illustrated in FIG. 1D), against which the disc spring makes contact during impact as the opposing surface becomes closer in proximity to the disc due to deflection by the impact force. The FAE may be subsequently deformed along its central, symmetrical axis of the conical disc and dissipates the impact energy over the time of impact.

The radius of the outer bottom edge of the circular cone-shaped disc may be larger than the top radius and the ratio of the radius of the outer bottom edge relative to the radius of the upper top edge may be greater than 1. The performance of the FAE (solid top cone-shaped disc spring) may be changed by adjusting the ratio of the top radius to the larger outer radius of the bottom edge of the disc as well as the material selection, degree of cross-sectional thickness and cross-sectional geometry of the cone-shaped disc.

Each disc spring of an FAE may be made of various different types of materials. For example, a disc spring may be constructed by the lamination of two or more planar plies of fiber-reinforced thermosetting or thermoplastic polymeric matrix materials. The structural composite plies used to construct the disc spring may be initially flexible fiber reinforced matrix composite materials to conform to a mold and rigid after cure or processing into a final shape by the mold. The number of plies and planar orientation of the plies may be used based on the designed structural mechanical performance of the FAE. Fiber reinforcements may be used as continuous or high aspect ratio discontinuous forms in the length axis of the fiber. Fiber reinforcement types used singly or in combinations may be carbon, glass, ceramic, metal and/or polymeric (organic) to achieve the designed strength and stiffness properties of the disc spring. Continuous thin metal layers (for surface or internal plies) may be used in the laminate construction of the disc spring in combination with fiber reinforced plies to achieve specific performance attributes of the fiber metal laminate disc spring. Single fiber types or combinations of fiber types within the laminate plies may be used within the disc spring to achieve specific weight, strength, stiffness, strain, density, durability, and/or vibration dampening properties of the final FAE.

Other discreet discontinuous reinforcements may be used in the thermosetting or thermoplastic matrix materials for achieving tailored performance properties of the matrix and resultant disc spring, which include micron and nano-sized filler particles and/or short micron-sized discontinuous filaments. These discreet discontinuous reinforcements may be used with or without the fiber reinforcements and continuous thin metal plies mentioned above. Disc springs may also be fabricated entirely of polymeric materials (thermoplastic or thermosetting) without continuous or discontinuous fiber reinforcement.

Figure 1B:
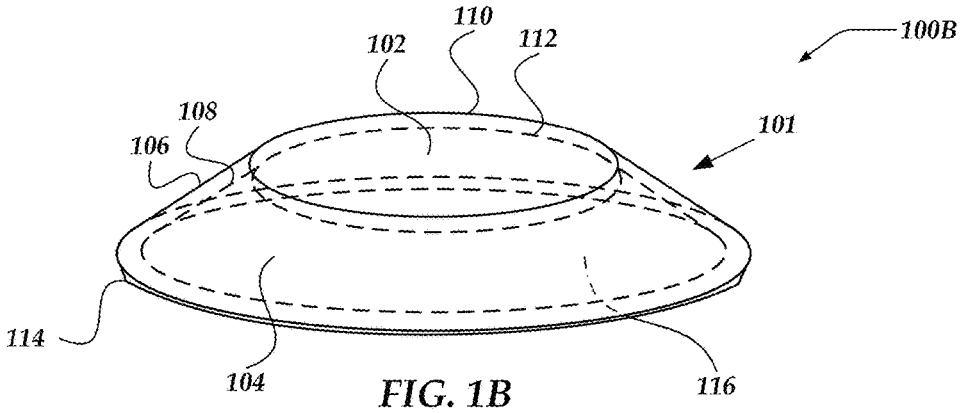

FIG. 1B shows a transparent view of FAE 100B. FAE 100B may be an embodiment of FAE 100A with a single disc spring (e.g., disc spring 101) having top 102 and skirt 104. Top 102 may include a top surface that is substantially parallel to a bottom surface, which are depicted by the edges of top surface 110 and bottom surface 112, respectively. Skirt 104 may include outside surface 106 that mirrors inside surface 108, such that inside surface 108 abuts aperture 116. Aperture 116 enables skirt 104 to deflect when a load is exerted on top 102 (or a load is exerted on a separate surface abutting and opposing skirt 104). Such a load is illustrated in FIG. 1D. In various embodiments, skirt 104 may include ring 114. In various embodiments, the ring may have a small surface area to reduce an amount of friction between skirt 104 and an opposing surface when the skirt deflects due to a load on the top, which is illustrated in FIG. 1D.

Figure 1C:
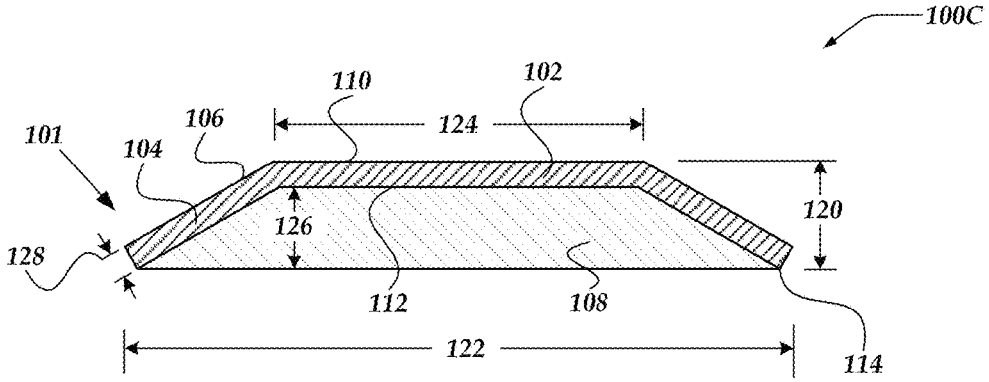
FIGS. 1C-1D show schematic cross-sectional views of a force-absorbing element of FIG. 1A or 1B in accordance with at least one of the various embodiments.
Figure 1D:
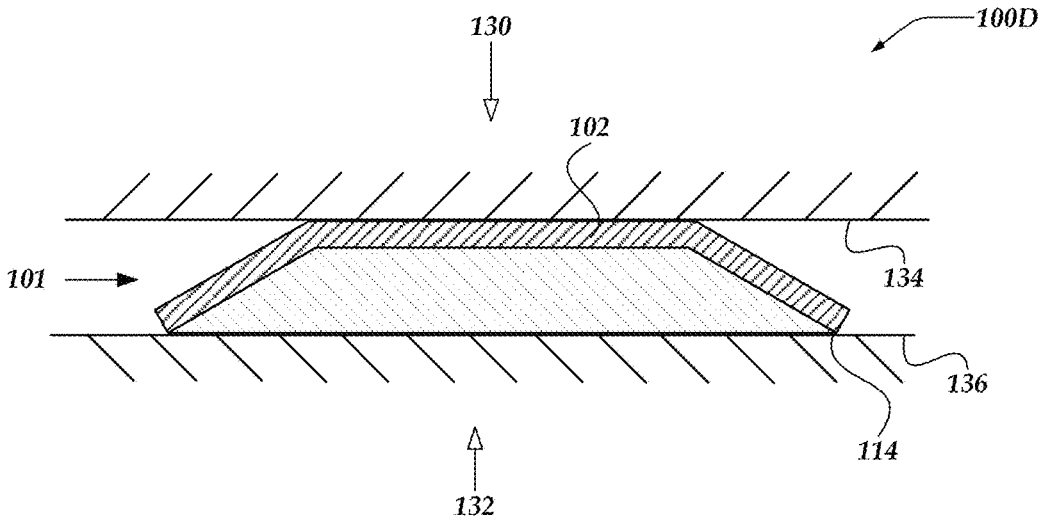

FIG. 1C shows a schematic cross-sectional view of a force-absorbing element of FIG. 1A or 1B in accordance with at least one of the various embodiments. FAE 100C may be an embodiment of FAE 100A with a single disc spring (e.g., disc spring 101). As illustrated, top 102 may connect with skirt 104 to create an aperture (e.g., aperture 116 of FIG. 1B) between inside surface 108 and bottom surface 112, such that inside surface 108 of skirt 104 is visible in this cross-sectional view. Ring 114 may be a ring-shaped edge surrounding the aperture, can abut an opposing surface (as illustrated in FIG. 1D). As used herein, top 102 may be referred to as a top of a disc spring, and ring 114 may be referred to as a bottom of a disc spring. In some embodiments, the bottom of a disc spring may not be a flange, but rather may be a planar ring that is substantially parallel to the top of the disc spring, such as shown by disc spring 410 or disc spring 412 of FIG. 4C.

Figure 2:
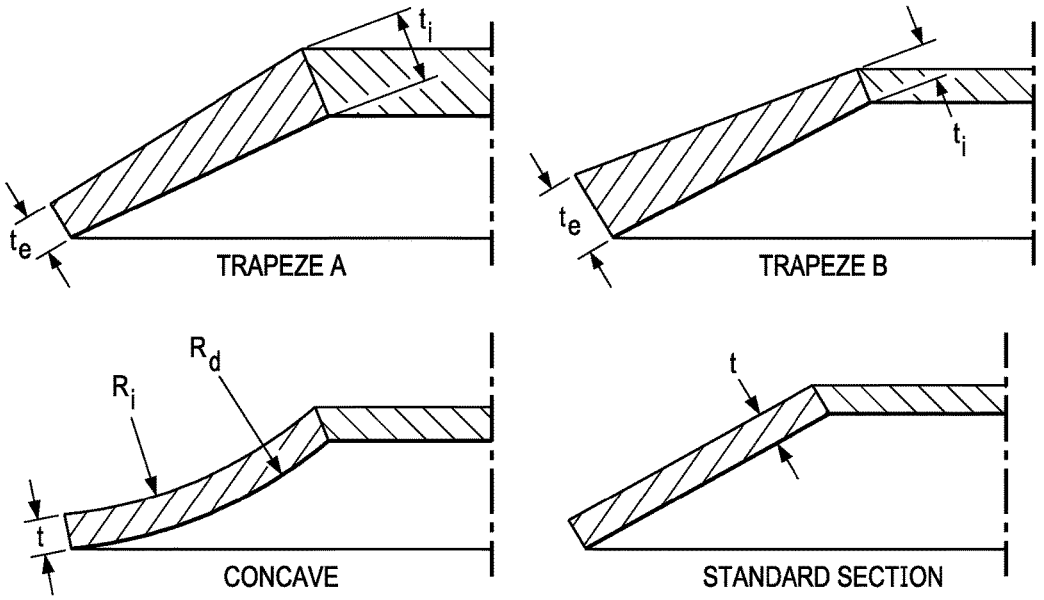
FIG. 2 shows a schematic cross-sectional views of a portion of a force-absorbing element in accordance with at least one of the various embodiments.

The disc spring may have a total diameter 122, which may be the diameter of an outer edge of skirt 104. The disc spring may have a top inner diameter 124, which may be the diameter of top 102. The disc spring may have an overall height 120, which may be the distance from top surface 110 to ring 114. The disc spring may have an internal height 126, which may be the distance from bottom surface 112 to ring 114 and may be a distance of maximum deflection for the disc spring. Also, the disc spring may have a thickness 128, which may be the distance between outside surface 106 and inside surface 108. The dimensions shown are for illustration purposes and a disc spring may have different thicknesses of materials and/or different dimensions than what is depicted. In various embodiments, these dimensions may be modified or changed to adjust the performance of the disc spring. For example, the performance of the disc spring may be changed by adjusting the ratio of the top inner diameter 124 to the larger total diameter 122 of the bottom edge of the disc. Similarly, changes in the material selection, degree of cross-sectional thickness, and cross-sectional geometry of the skirt (e.g., the cone-shaped disc) may also change the performance of the disc spring. FIG. 2 illustrates various different possible cross-sectional thicknesses/geometries of the disc spring.

FIG. 1D shows a schematic cross-sectional view of a force-absorbing element of FIG. 1A or 1B in accordance with at least one of the various embodiments. FAE 100D may be an embodiment of FAE 100A having a single disc spring (e.g., disc spring 101). As illustrated, the disc spring may compress perpendicular to the central axis of the disc spring by a force 130 applied to top 102 or a force 132 applied to an opposing surface (e.g., surface 136) opposite and abutting ring 114. In some embodiments, force 130 may apply directly to top 102 or to a separate opposing surface (e.g., surface 134) that opposes and abuts top 102. So the direction of compression may be perpendicular to top 102 and ring 114 and parallel to the central axis of symmetry of disc spring 101.

In various embodiments, the opposing surface (e.g., surface 136) against which the disc spring deflects and dampens impact forces may depend on the end-use application for the FAE. The structural form of the opposing surface may be of sufficient stiffness, strength, and minimal frictional coefficient (smoothness) to enable the disc spring to flex and deform during impact to its designed loading level to function as an FAE. It should also be recognized that surface 134 may include many of the same characteristics of surface 136 to enable the disc spring to deflect and absorb an impact force. Moreover, surface 134 and/or surface 136 may be planar, curved (concave or convex relative to the FAE), toothed, wavy, sinusoidal, or the like.

In various embodiments, the structure of surface 136 may be made of a material that has a low coefficient of friction. Similarly, surface 136 (e.g., an interior of a helmet shell) may be covered in a coating (e.g., Teflon) that has a coefficient of friction that is lower than the material of the structure opposing the FAE. In this way, the FAE (e.g., ring 114) may begin to slide on surface 136 as the FAE begins to deflect/flex due to an applied load.

The FAE arrangement and configurations described herein may have many advantages. For example, a light-weight design that may be capable of sustaining high spring forces during impact events with low deflection in a very compact envelope. Similarly, a light-weight design that may be highly elastic without permanent deformation over multiple impact events when utilized within its designed load-deflection limits. The light-weight designed device may have high damping capability, especially with multiple disc sub-elements used in parallel. Also, an FAE that may be adaptable to a wide range of applications due to the ability to tailor its load-deflection curves by selecting appropriate: laminate construction materials (fiber and matrix) for the composite disc; ply count and orientations for the composite laminate disc; cross-sectional geometry of the composite disc; or disc spring sub-element arrangement combinations. In operation, the FAE may provide improvement in structures and applications that utilize impact protection, shock dampening, and multi-stage impact energy dissipation.

Figure 1E:
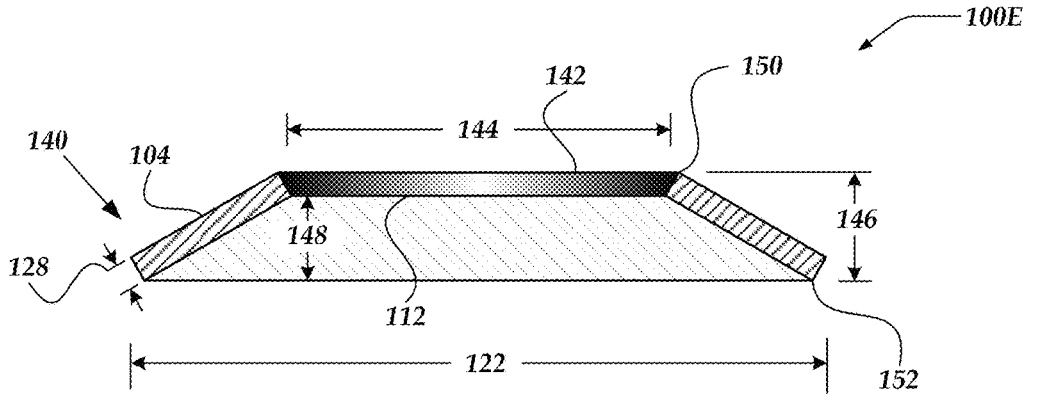
FIG. 1E shows a schematic cross-sectional view of an alternative force-absorbing element of FIG. 1A or 1B in accordance with at least one of the various embodiments.

FIG. 1E shows a schematic cross-sectional view of an alternative force-absorbing element of FIG. 1A or 1B in accordance with at least one of the various embodiments. FAE 100E may be an alternative embodiment of FAE 100A with a conventional Belleville washer (e.g., disc spring 140). As illustrated, top 142 may be an aperture inside a top of skirt 104 surrounded by top ring 150. Top ring 150 may be a ring-shaped edge surrounding the top of skirt 104. Bottom ring 152 may be a ring-shaped edge surrounding the bottom of skirt 104. Top ring 150 and/or bottom ring 152 can abut an opposing surface (as illustrated in FIG. 1D). As used herein, top 142 and/or top ring 150 may be referred to as a top of the disc spring, and bottom ring 152 may be referred to as a bottom of the disc spring.

The disc spring may have a total diameter 122, which may be the diameter of an outer edge of skirt 104. The disc spring may have a top inner diameter 144, which may be the diameter of top ring 150 (i.e., the diameter of the aperture of top 144). The disc spring may have an overall height 146, which may be the distance from top ring 150 (i.e., a top of top 142) to bottom ring 152. The disc spring may have an internal height 148, which may be the distance from a bottom of top 142 to bottom ring 152 and may be a distance of maximum deflection for the disc spring. Also, the disc spring may have a thickness 128. The dimensions shown are for illustration purposes and a disc spring may have different thicknesses of materials and/or different dimensions than what is depicted. In various embodiments, these dimensions may be modified or changed to adjust the performance of the disc spring.

FIG. 2 shows schematic cross-sectional views of a portion of a force-absorbing element in accordance with at least one of the various embodiments. As illustrated in FIG. 2, the skirt may have various different thicknesses and/or geometries depending on the designed load and deflection characteristics of a disc spring. Example geometries laterally along the skirt may include, but are not limited to trapeze, reverse trapeze, concave, standard, or the like.

Figure 3A:
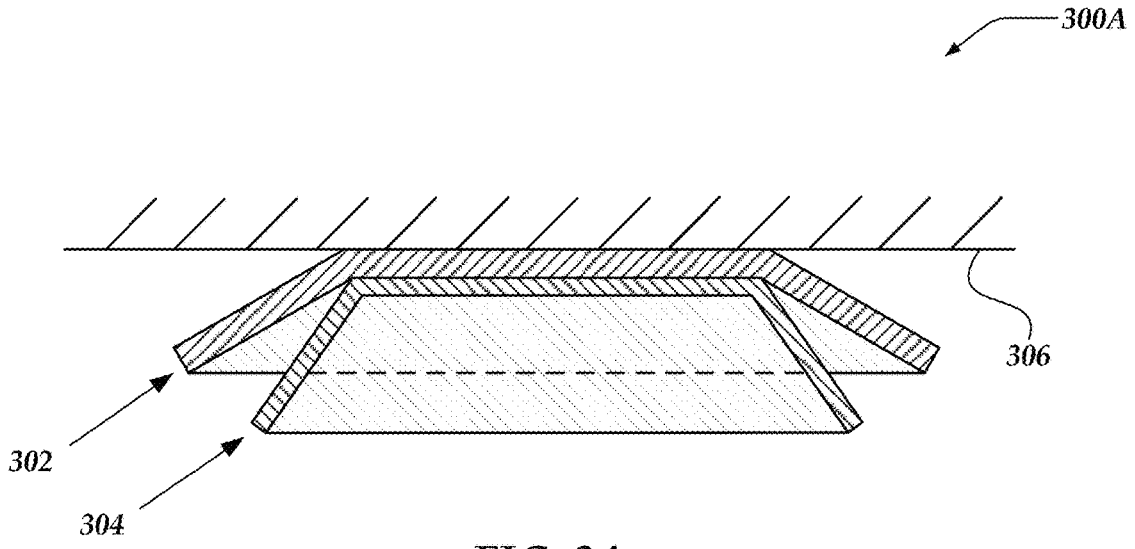
FIG. 3A shows a schematic cross-sectional view of an alternative arrangement of a force-absorbing element in accordance with at least one of the various embodiments.

FIG. 3A shows a schematic cross-sectional view of an alternative arrangement of a force-absorbing element in accordance with at least one of the various embodiments. In various embodiments, an FAE may include one or more disc springs.

In an FAE that includes a plurality of disc springs, one or more of the disc springs may have similar dimensions, geometries, characteristics, and/or parameters (e.g., as illustrated in FIG. 4A-4C, or 8-10) and/or one or more of the disc springs may have different dimensions, geometries, characteristics, and/or parameters (e.g., as illustrated in FIG. 3A or 11-13). Different disc spring dimensions, geometries, characteristics, and/or parameters may enable different disc springs to have different load capacities and/or different deflection distances, which may result in an FAE with a multi-stage load-deflection profile.

As illustrated, FAE 300A may include a plurality of disc springs, such as disc spring 302 and 304. Disc springs 302 and 304 may be in a stacked parallel configuration, such that one disc spring fits inside the aperture of the other disc spring with the top surface (e.g., top surface 110 shown in FIG. 1C) of the top planar surface of one disc spring (e.g., disc spring 304) abuts the bottom surface (e.g., bottom surface 112 shown in FIG. 1C) of the top planar surface of another disc spring (e.g., disc spring 302). In this illustration, disc spring 304 may be inside the aperture of disc spring 302.

Figure 4A:
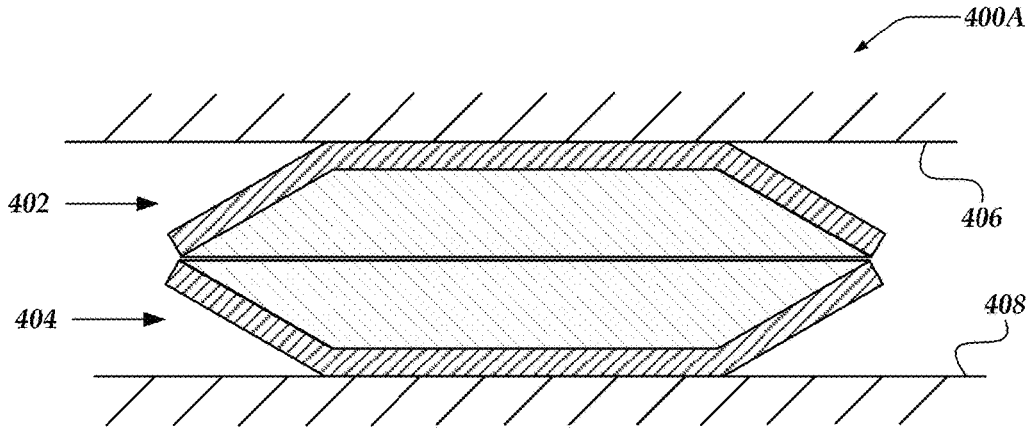
FIGS. 4A-4C show schematic cross-sectional views of alternative arrangements of a force-absorbing element in accordance with at least one of the various embodiments.

In various embodiments, disc spring 304 may be connected to disc spring 302 by a variety of different adhesives, fasteners, pressure fit (e.g., between two rigid surfaces, such as illustrated in FIG. 4A), or the like.

As described above, disc springs may have different load capacities and/or different deflection distances, which may be based on differing geometry/characteristics of each disc spring. For example, disc spring 304 may have a smaller total diameter (e.g., total diameter 122 identified in FIG. 1C) than disc spring 302. Disc spring 304 may have a larger internal height (e.g., internal height 126 identified in FIG. 1C) than disc spring 302. Also, disc spring 304 may be thinner (e.g., thickness 128 identified in FIG. 1C) than disc spring 302.

These differing geometry/characteristics may result in one or more of the plurality of disc springs may have a higher load capacity than another disc spring and/or one or more of the plurality of disc springs may have a longer deflection distance than another disc spring. For example, disc spring 302 may have a higher load capacity than disc spring 304. And disc spring 304 may have a longer deflection distance than disc spring 302.

In this way, upon a force being applied to the FAE (from either the top through surface 306 or from a surface opposing the bottom of the FAE (not illustrated)), the FAE may absorb the force in multiple stages over the total deflection distance of the FAE (where in this case the total deflection distance may be that disc spring 304). For example, disc spring 304 may deflect and absorb an initial amount of force until disc spring 304 is deflected enough to engage disc spring 302. At which point, both disc springs together may continue to deflect and absorb additional force beyond the initial force. It should be recognized that once both disc springs are fully deflected, little additional force may be absorb by the FAE.

In some embodiments, FAE 300A may be affixed or otherwise abut a rigid surface, such as surface 306. Surface 306 is illustrated as a flat surface for ease of illustration, but embodiments are not so limited, and FAE 300A may fix or otherwise abut a curved surface, wavy surface, toothed surface, or the like. In various embodiments, surface 306 may be an embodiment of surface 134 of FIG. 1D.

Figure 3B:
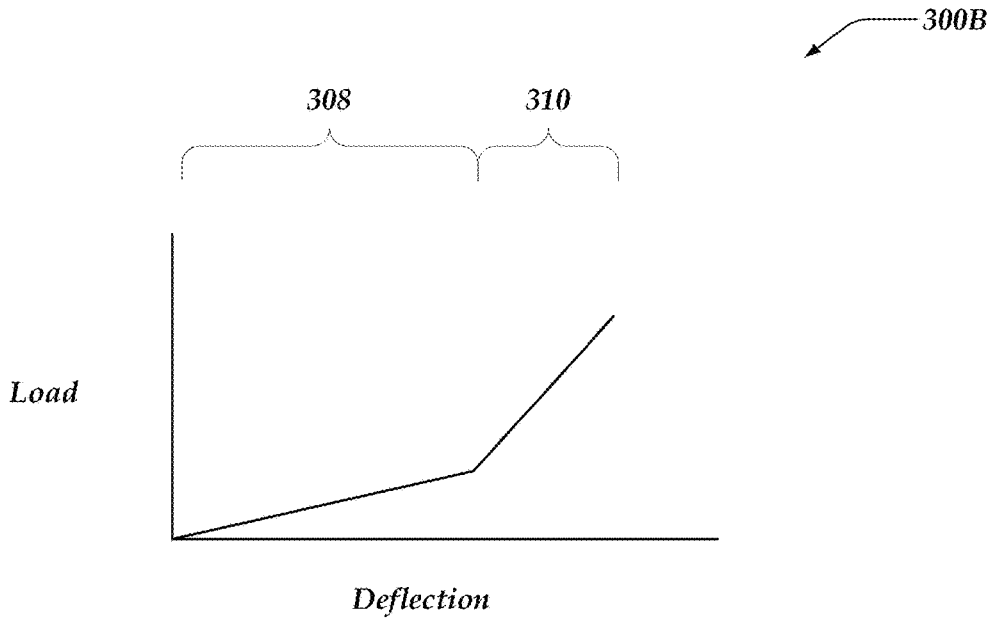
FIG. 3B illustrates a graph showing the load versus deflection profile of a force-absorbing element of FIG. 3A.

FIG. 3B illustrates a graph showing the load versus deflection profile of a force-absorbing element of FIG. 3A. Example 300B illustrates a two-stage load-deflection profile of FAE 300A of FIG. 3A. As described above, disc spring 304 may absorb an initial force/load (illustrated by line segment 308), and both disc spring 304 and disc spring 302 may combine to absorb additional force/load (illustrated by line segment 310).

FIG. 4A shows a schematic cross-sectional view of alternative arrangements of a force-absorbing element in accordance with at least one of the various embodiments. FAE 400A may include a plurality of separate disc springs, such as disc spring 402 and disc spring 404. In various embodiments, disc spring 402 and disc spring 404 may be embodiments of the disc spring 101 of FIG. 1A. In some embodiments, disc spring 402 and disc spring 404 may have the same geometries and characteristics, such as same load and deflection capabilities. In other embodiments, disc spring 402 and disc spring 404 may have different geometries and/or characteristics, such that the load and/or deflection capabilities differ between the disc springs.

As illustrated, disc spring 402 and disc spring 404 may be arranged and configured in series such that one disc spring is inverted and the bottom of disc spring 402 abuts the bottom of disc spring 404. In this way, a bottom ring (e.g., ring 114 of FIG. 1C) of one disc spring may abut a bottom ring of the other disc spring. In various embodiments, these disc springs may be connected by pressure fit between rigid surfaces 406 and 408.

Figure 4B:
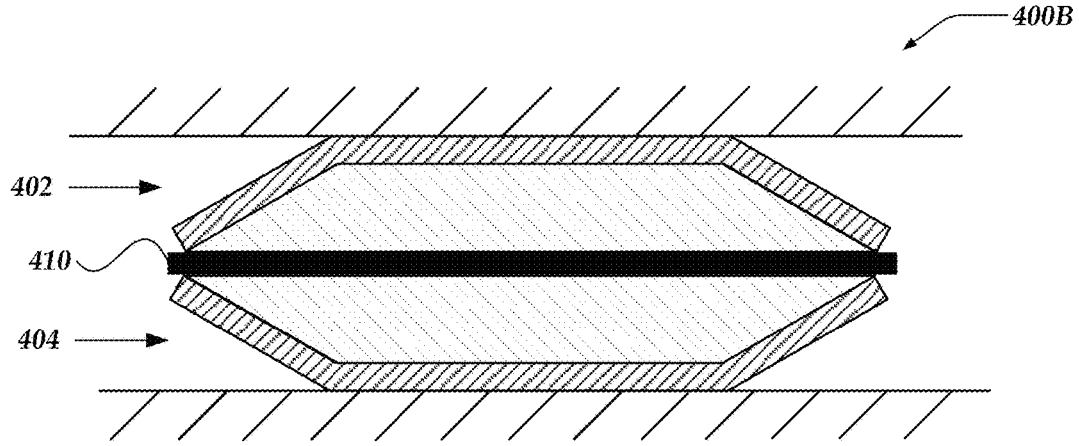

FIG. 4B shows a schematic cross-sectional view of alternative arrangements of a force-absorbing element in accordance with at least one of the various embodiments. FAE 400B may employ embodiments of FAE 400A of FIG. 4A, but with elastomeric spacer 410. Elastomeric spacer 410 may be a disk, ring, or other spacer that separates disc spring 402 and 404. Elastomeric spacer 410 may be made of an elastomeric or low modulus polymeric material. Elastomeric spacer 410 may provide additional load distribution, while increasing the deflection distance of FAE 400B.

Figure 4C:
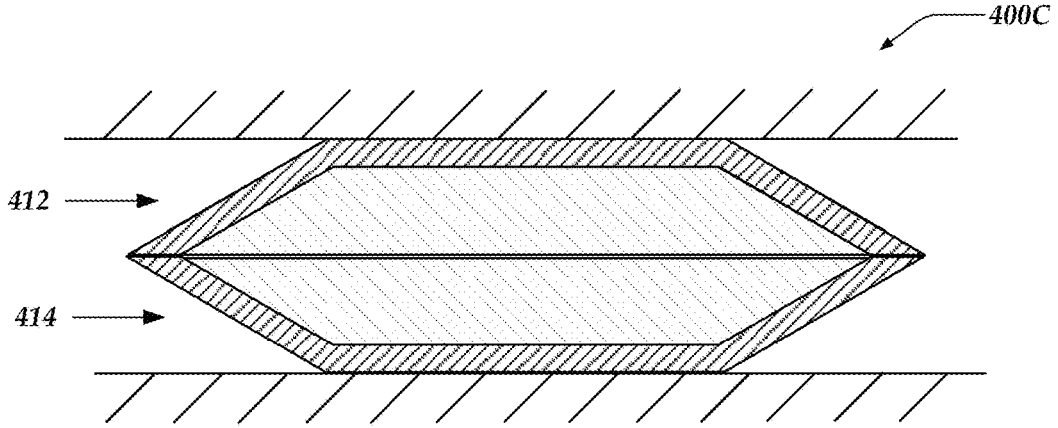

FIG. 4C shows a schematic cross-sectional view of alternative arrangements of a force-absorbing element in accordance with at least one of the various embodiments. FAE 400C may employ embodiments of FAE 400A of FIG. 4A, but where each of disc spring 412 and/or disc spring 414 includes a planar ring bottom that is substantially parallel to the top planar surface of the corresponding disc spring. Embodiments of an FAE may also include disc spring 412 in combination with disc spring 404 in a similar arrangement as shown in FIGS. 4A-4C (i.e., where one disc spring is inverted in relation to the other so that the bottom of one disc spring abuts the bottom of the other disc spring.

Figure 5:
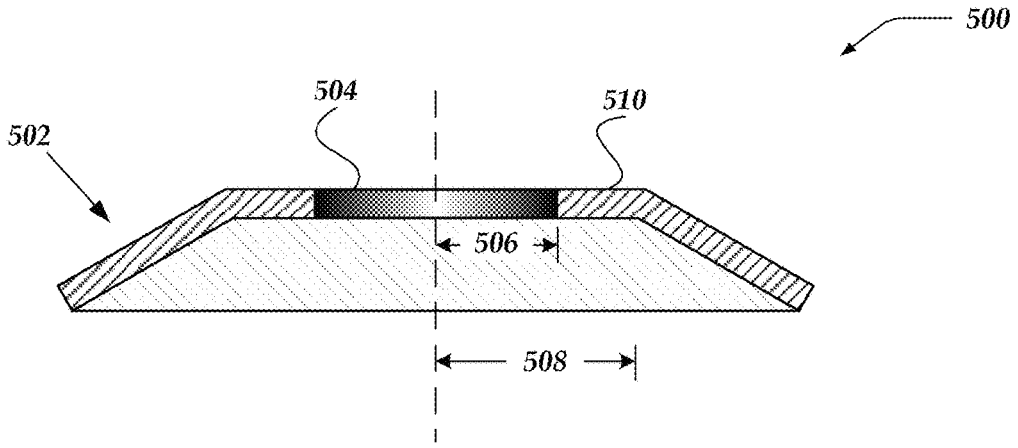
FIG. 5 shows a schematic cross-sectional view of an alternative arrangement of a force-absorbing element in accordance with at least one of the various embodiments.

FIG. 5 shows a schematic cross-sectional view of an alternative arrangement of a force-absorbing element in accordance with at least one of the various embodiments.

FAE 500 may be an embodiment of FAE 100A of FIG. 1A. Disc spring 502 may be an embodiment of disc spring 101 of FIG. 1A but where the top planar surface of disc spring 502 includes aperture 504. Aperture 504 may be a circular opening in the top of disc spring 502, where aperture 504 is aligned central to the disc spring's central axis of symmetry. In various embodiments, radius 506 of aperture 504 may be less than radius 508 of top surface 510 (which may be referred to as a joining planar surface).

Figure 7:
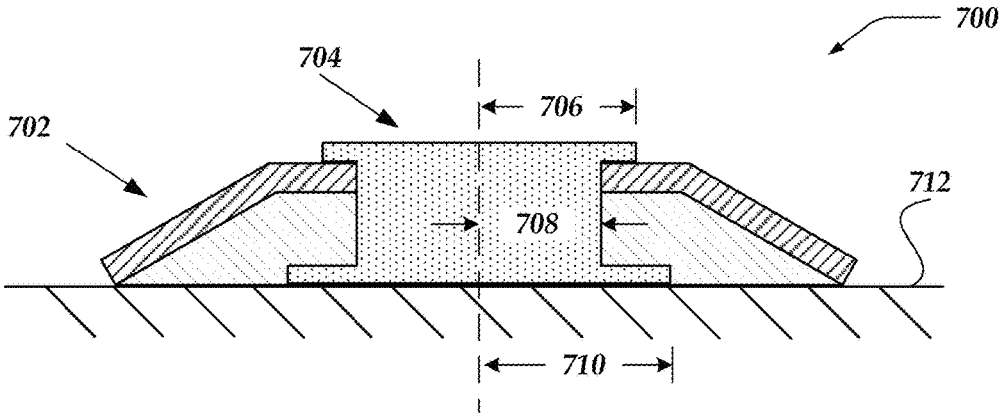
FIG. 7 shows a schematic cross-sectional view of an alternative arrangement of a force-absorbing element that utilizes an elastomeric component in accordance with at least one of the various embodiments.

Aperture 504 may be a central opening or hole in the cone-shaped disc, which can reduce the weight of disc spring 502 relative to disc spring 101A of FIG. 1. Additionally, aperture 504 may provide an annular planar surface integral with the outer top edge of the disc spring, which may be used to join or otherwise connect FAE 500 to a surface. In various embodiments, FAE 500 may be positioned with the bottom (e.g., ring 114 of FIG. 11C) of disc spring 502 either in contact with or in proximity to an opposing planar or gradually curved (either convex or concave) surface that is perpendicular to the central, symmetrical axis of the disc spring. The positioning of FAE 500 may be one such that the bottom of disc spring 502 may make contact with the opposing surface (e.g., as shown in FIG. 7) in response to an impact force on FAE 500 (i.e., a force that is perpendicular to the central, symmetrical axis of the disc spring or FAE 500), which may cause disc spring 502 to deflect and absorb the impact force.

In various embodiments, the opposing surface against which the disc spring deflects and dampens impact forces may depend on the end-use application for the FAE. The structural form of the opposing surface may be of sufficient stiffness, strength, and minimal frictional coefficient (smoothness) to enable the disc spring to flex and deform during impact to its designed loading level to function as an FAE.

Top surface 510, or the joining planar surface of the disc spring, may allow for a rivet-like connector, such as an elastomeric component (which is described in more detail below in conjunction with FIG. 6), to be used to join two or more disc springs in in a stacking arrangement of an FAE. As described herein, these multiple disc springs may be of similar or different geometries and/or stiffness properties with specific load-deflection properties that may be designed and/or tailored to various applications. Such an application might include, but is not be limited to, an FAE that may be capable of dampening a low energy impact as well as a high energy impact.

An example of such an FAE may include, but is not be limited to, a double stacked disc spring arrangement (similar to that shown in FIG. 3A or 11-13) yielding a two-stage load-deflection performance. In this FAE arrangement the underlying disc spring may have a lower stiffness (and different geometry) and lower maximum loading capacity than the upper disc spring. Therefore, upon reaching the maximum loading of the lower disc spring, the upper disc spring may absorb the load at a steeper load-deflection slope.

As described above, FIG. 3A illustrates an embodiment of an FAE with a stacked disc spring configuration yielding at least a two stage load-deflection shock absorption performance curve. I, two shock absorbing elements aligned and facing each other (e.g., as shown in FIGS. 4A-4C) may also be utilized to obtain multi-stage load-deflection performance. Other embodiments, of employing multiple disc springs in an FAE is illustrated in FIGS. 8-19.

Figure 6:
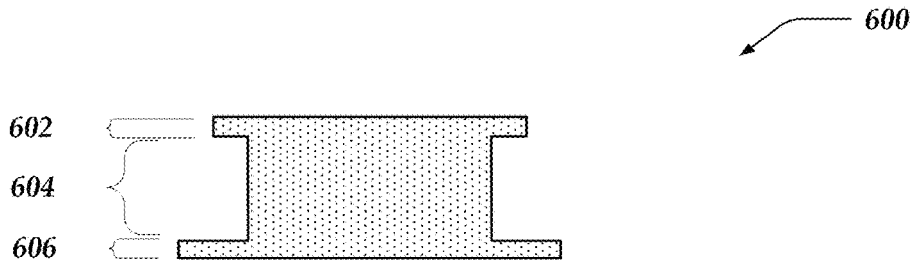
FIG. 6 shows a schematic cross-sectional view of an elastomeric component that can be used in alternative arrangements of a force-absorbing element in accordance with at least one of the various embodiments.

FIG. 6 shows a schematic cross-sectional view of an elastomeric component that can be used in alternative arrangements of a force-absorbing element in accordance with at least one of the various embodiments. Elastomeric component 660 may be made of an elastomeric or low modulus polymeric material. Briefly, elastomeric component 600 may include a planar base (e.g., base 606) with a central cylindrical protrusion (e.g., body 604) having at the opposite end a circular and flanged end (e.g., flange 602). The circular flanged end may have a greater outside diameter than the top diameter of the disc spring so as to retain the disc spring onto the central cylinder or rod, once the disc spring is pressed beyond the flexible flange, retaining the disc perpendicular to the disc's symmetrical central axis between the flange and planar base.

Elastomeric component 600 may include base 606, body 604, and flange 602. Base 606 and flange 602 may be at opposite ends of body 604. In various embodiments, base 606 and/or flange 602 may have an external diameter that is greater than a diameter of an aperture in the top of at least one disc spring, so as to retain the at least one disc spring on body 604 (e.g., as shown in FIGS. 7-15). Although base 606 is illustrated with a greater diameter than flange 602 embodiments are not so limited and base 606 and flange 602 may have similar diameters or a diameter of flange 602 may be greater than a diameter of base 606.

Similarly, body 604 may have a diameter that is similar to and/or slightly smaller than the diameter of the aperture in the top of the at least one disc spring, which can matably receive one or more disc springs. The body may orient the at least one disc spring about a symmetrical central axis of an FAE (i.e., a central axis perpendicular to the top of the at least one disc spring). A length of body 604 may be varied and designed to hold multiple adjacent disc springs in parallel (stacked in same facing direction) or in series (arranged in an opposing sequence), or other combinations of facing or opposing directions.

Figure 13:
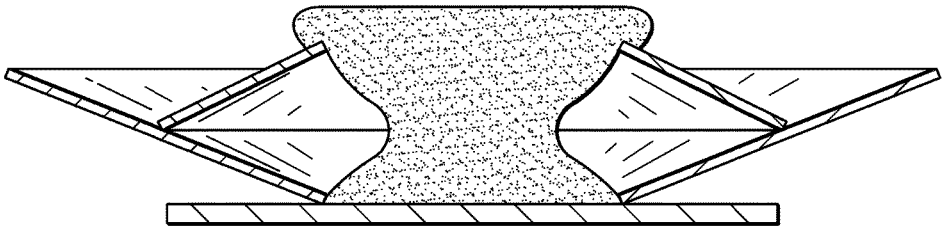

In various embodiments, base 606, body 604, and flange 602 may be circular and/or cylindrical. However, embodiments are not so limited and other shapes may be employed. For example, body 604 may be an hourglass shape or other shape such that a middle of the body has a diameter that is small than a diameter of each end of the body, such as illustrated in FIG. 13.

In some embodiments, base 606 and/or flange 602 may be arranged and/or configured to connect an FAE to an opposing surface that is separate from the FAE and/or orient one or more disc springs of an FAE into a designed arrangement and/or configuration.

FIG. 7 shows a schematic cross-sectional view of an alternative arrangement of a force-absorbing element that utilizes an elastomeric component in accordance with at least one of the various embodiments. FAE 700 may include disc spring 702 and elastomeric component 704. In various embodiments, disc spring 702 may be an embodiment of disc spring 502 of FIG. 5. And elastomeric component 704 may be an embodiment of elastomeric component 600 of FIG. 6.

The elastomeric component acts to align one or more disc springs of the FAE through their central axis. The elastomeric component may also act as a contributor to the force-absorbing character of the total FAE by attenuating lower levels of impact force below and up to the threshold force capability of the disc springs of the FAE, which can increase a number of load-deflection performance stages of the FAE without increasing the number of disc springs. In some embodiments, the elastomeric component may act a connector to attach the disc spring(s) of the FAE to a surface.

As illustrated, radius 706 of the flange of elastomeric component 704 may be greater than radius 708 of the base of elastomeric component 704. Similarly, radius 710 of the base of elastomeric component 704 may be greater than radius 708 of the base of elastomeric component 704. In various embodiments, the base of elastomeric component 704 may be connected to surface 712, such as by adhesive, hook and loop connectors, or the like. In should be understood that in some embodiments, elastomeric component 704 may not include a base and may connect directly to surface 712.

Moreover, radius 708 may be designed such that disc spring 702 may not shift horizontal to the central line of symmetry of FAE 700.

Figure 8:
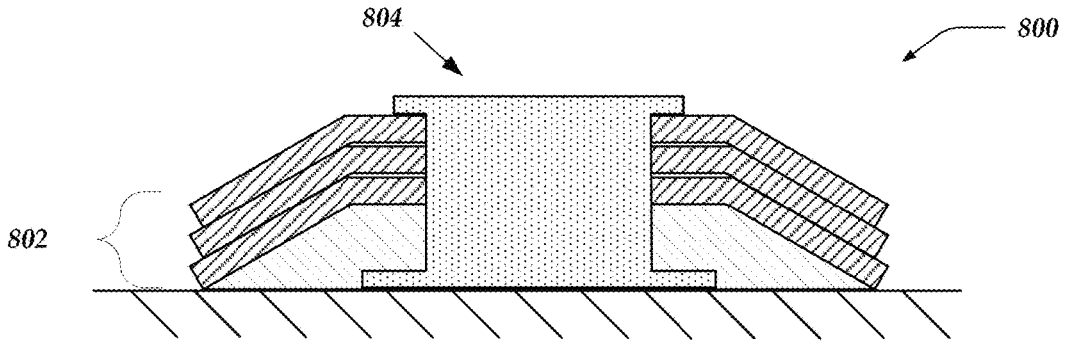
FIGS. 8-10 show schematic cross-sectional views of alternative arrangements of a force-absorbing element utilizing an elastomeric component in accordance with at least one of the various embodiments.
Figure 9:
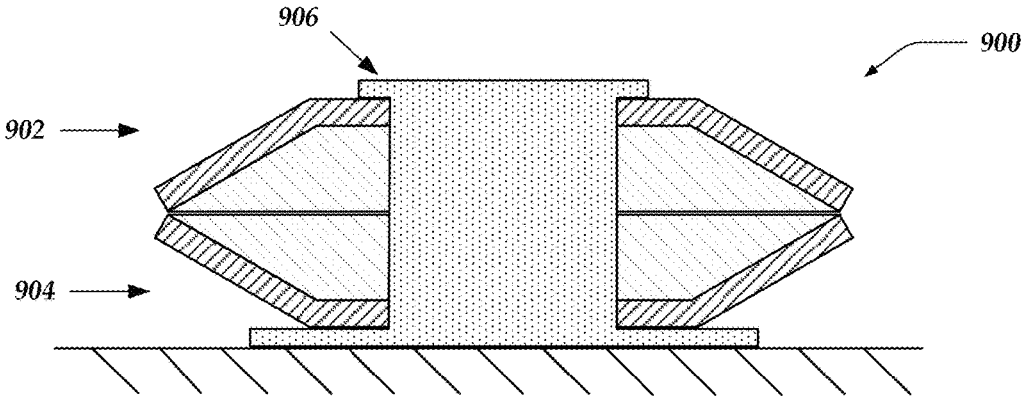
Figure 10:
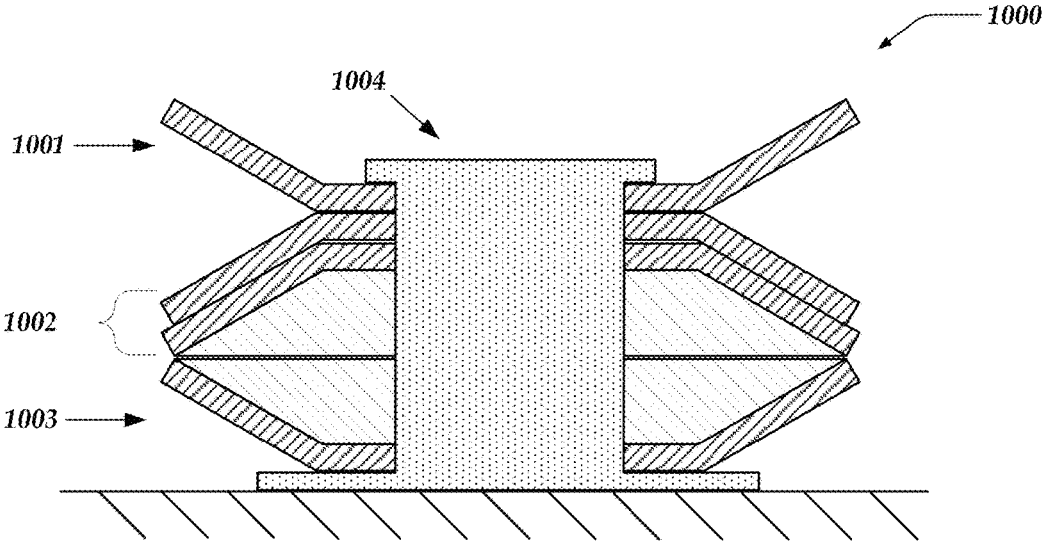

FIGS. 8-10 show schematic cross-sectional views of alternative arrangements of a force-absorbing element utilizing an elastomeric component in accordance with at least one of the various embodiments.

FAE 800 of FIG. 8 may include a plurality of similar disc springs in a parallel arrangement. FAE 800 may include disc springs 802 and elastomeric component 804. Each of disc springs 802 may be an embodiment of disc spring 502 of FIG. 5. And elastomeric component 804 may be an embodiment of elastomeric component 600 of FIG. 6. Elastomeric component 804 may orient disc springs 802 and may be utilized to connect FAE 800 to a surface.

FAE 900 of FIG. 9 may include a plurality of similar disc springs in a series arrangement. FAE 900 may include disc spring 902, disc spring 904, and elastomeric component 906. Each of disc springs 902 and 904 may be an embodiment of disc spring 502 of FIG. 5. Elastomeric component 906 may be an embodiment of elastomeric component 600 of FIG. 6. Elastomeric component 906 may orient disc springs 902 and 904 and may be utilized to connect FAE 900 to a surface.

FAE 1000 of FIG. 10 may include a plurality of similar disc springs in a combination of series and parallel arrangement. FAE 1000 may include disc springs 1001-1003 and elastomeric component 1004. Each of disc springs 1001-1003 may be an embodiment of disc spring 502 of FIG. 5. Elastomeric component 1004 may be an embodiment of elastomeric component 600 of FIG. 6. Elastomeric component 1004 may orient disc springs 1001-1003 and may be utilized to connect FAE 1000 to a surface.

Figure 11:
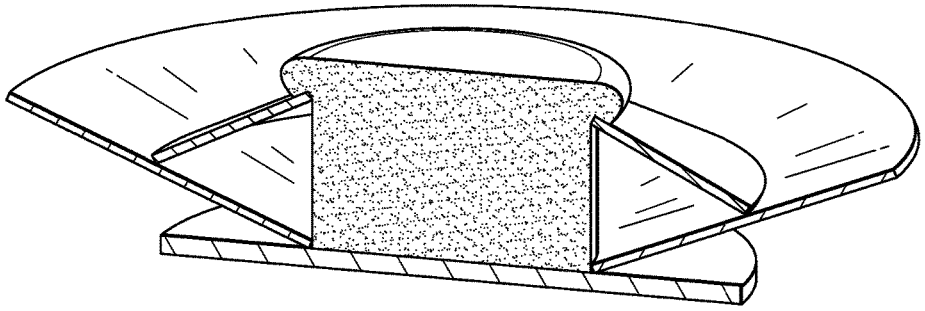
FIGS. 11-19 show schematic perspective or cross-sectional views of alternative arrangements of a force-absorbing element utilizing an elastomeric component in accordance with at least one of the various embodiments.
Figure 12:
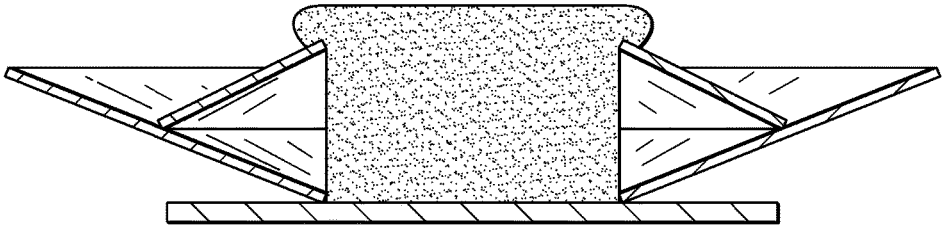

FIGS. 11-19 show schematic perspective or cross-sectional views of alternative arrangements of a force-absorbing element utilizing an elastomeric component in accordance with at least one of the various embodiments;

FIGS. 11-13 illustrate an FAE utilizing an elastomeric component to orient two disc springs in a series arrangement and configuration. As illustrated, one disc spring may have a smaller diameter than the second disc spring, such that the smaller diameter disc spring engaging the inside skirt of the larger diameter disc spring. FIG. 13 includes an hourglass-shaped elastomeric component, rather than the cylindrical elastomeric component in FIGS. 11 and 12.

Figure 14:
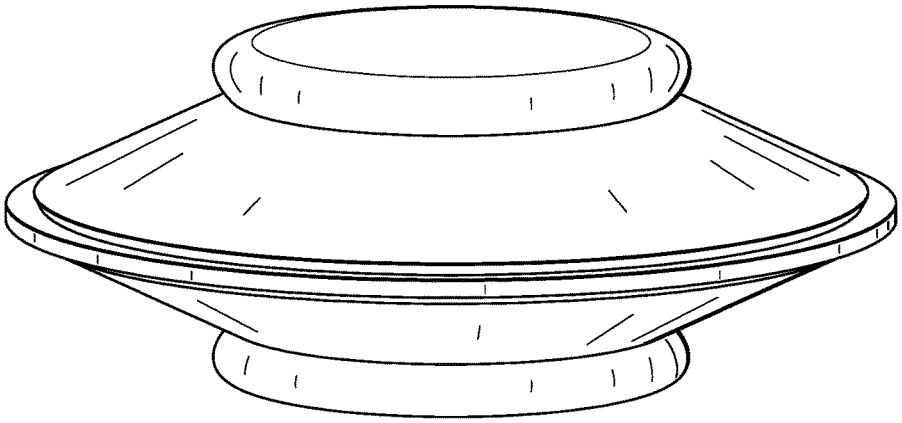
Figure 15:
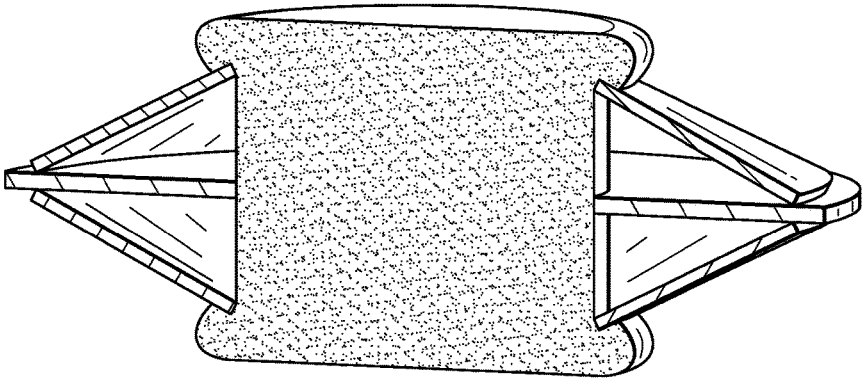

FIGS. 14 and 15 illustrate an FAE utilizing an elastomeric component to orient two disc springs in a series arrangement and configuration with an elastomeric ring spacer between the two disc springs. FIGS. 14 and 15 show various alternative views of embodiments described above in conjunction with FIG. 4B, but with the use of an elastomeric component.

Figure 16:
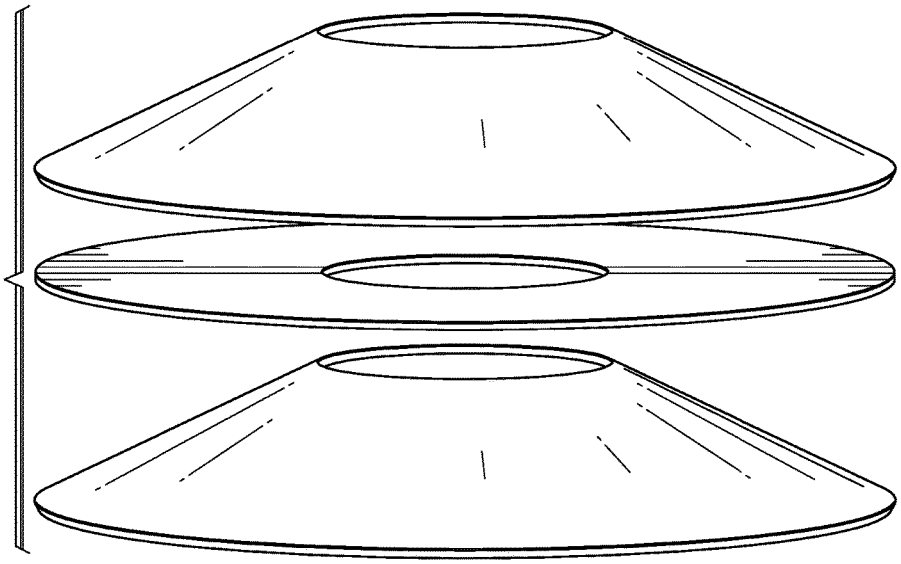
Figure 17:
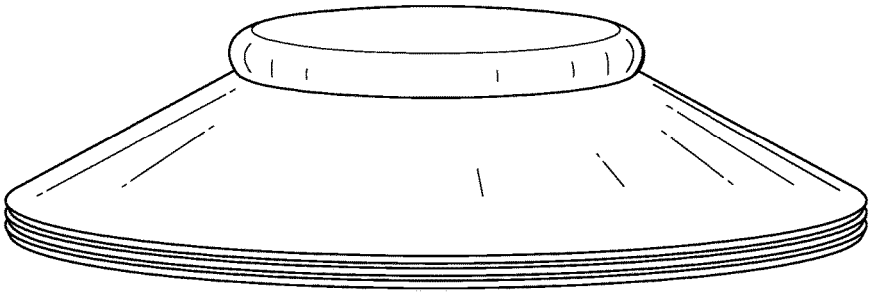
Figure 18:
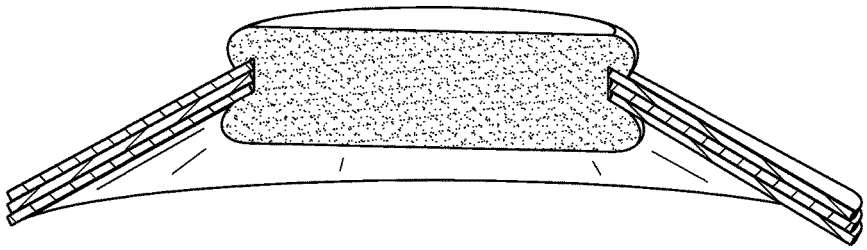

FIGS. 16-18 illustrate an FAE utilizing an elastomeric component to orient two disc springs in a parallel arrangement and configuration with an elastomeric ring spacer between the two disc springs. The elastomeric spacer in this configuration may be solid or foam (open or closed cell foam) or molded with internal hollow voids, chambers or channels. Moreover, one or both surfaces of the spacer may be toothed, wavy, sinusoidal, or the like. FIGS. 16-18 show various alternative views of embodiments described above in conjunction with FIG. 8, but with the use of two disc springs and an elastomeric spacer between the disc springs.

Figure 19:
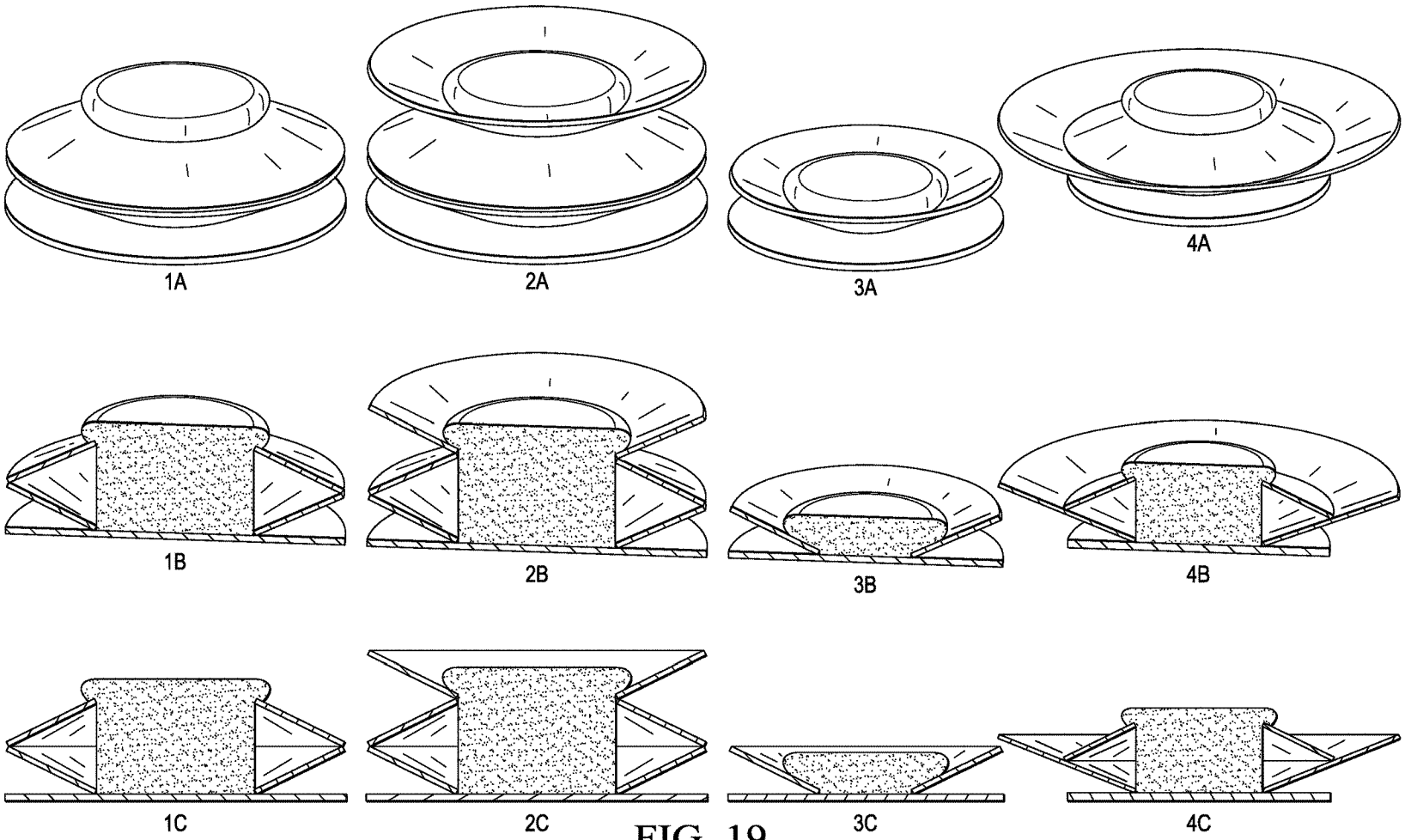

FIG. 19 illustrates a variety of FAEs utilizing an elastomeric component to orient one or more disc spring, as described herein.

FIGS. 20-23 show schematic perspective or cross-sectional views of alternative embodiments of a helmet employing force-absorbing elements in accordance with at least one of the various embodiments. Most of today's foam materials, especially in helmets, lose their protective capability upon reaching approximately 80% compression during high impact events. The capabilities and/or parameters (e.g., load-deflection profile) could be designed and/or tailored to dissipate high impact energies beyond the limits of current foam materials thereby potentially reducing serious injuries.

In various embodiments, one or more FAEs, as described herein, may be employed on an interior shell of a helmet. Helmets for various sporting, outdoor, and/or professional activities may utilize FAEs to absorb impact forces. These activities/helmets may include, but are not limited to, football, biking, skiing, motorcycling, equestrian, mountaineering, rock/ice climbing, hockey, lacrosse, race car driving, soccer, rugby, baseball, wrestling, skateboarding, snowboarding, in-line skating, kayaking, surfing, all-terrain vehicle riding, snowmobile riding, military helmets, hardhats, mining helmets/hardhats, firefighter helmets/hardhats, or helmets used in a variety of other activities.

In various embodiments, at least one FAE, as described herein, may be mounted to the interior of a helmet at one or more strategic locations. The FAEs may be mounted on the inside of the outer shell. In some embodiments, the FAE may be between the outer shell and impact absorbing foam cushion materials. In other embodiments, the FAEs may be embedded in the foam cushions with the FAE positioned to abut the inside of the outer shell. Various examples of potential helmet locations for mounting one or more FAEs is shown in FIGS. 20-23.

In various embodiments, a helmet may be adapted for use by a human being for a variety of activities. The helmet may include a shell, a plurality of FAEs, and at least one rigid component. The shell may have a rounded convex exterior surface (referenced from the exterior of the helmet) and a rounded concave interior surface (referenced from the interior of the helmet). The plurality of FAEs may be separately positioned adjacent to the shell's interior surface. As described herein, each FAE may include at least one disc spring that is adapted for absorbing forces. In some embodiments, at least one FAE may include two or more disc springs, which may each be separated by at least one elastomeric spacer.

The at least one rigid component may be disposed within the shell and adjacent to the plurality of FAEs. In this way, the plurality of FAEs may be between the shell's interior surface and the at least one rigid planar component. When a force is applied to a location on the shell's exterior surface, it may be substantially absorbed by at least one of the plurality of FAEs separately positioned adjacent to the location on the shell's interior surface.

In some embodiments, separate portions of the plurality of FAEs may be positioned adjacent to the shell's interior surface at more than one different location, including a front, a back, a side, or a top. In at least one of various embodiments, at least one cushioned component may at least partially enclose the plurality of FAEs are at least partially enclosed.

In various embodiments, each FAE further may include a top plane and a bottom plane that are substantially parallel to each other, wherein either the top plane or the bottom plane is positioned adjacent to the shell's interior surface. In some embodiments, at least some of the FAEs may include an elastomeric component. The elastomeric component may have a cylindrical body that is positioned in an aperture that is formed through a top plane of the at least one disc spring. A portion of at least one end of the elastomeric component may have a diameter that is larger than a diameter of the cylindrical body and a diameter of the aperture. In some embodiments, the cylindrical body of the elastomeric component may be substantially formed in an hourglass shape to prevent the elastomeric component from interfering with the disc spring as the disc spring and elastomeric component compress due to an applied force.

In some embodiments, at least one of the plurality of FAEs may include a force sensing film that changes color when a predetermined amount of force is applied to the exterior surface of the shell or emits an electrical charge via a piezoelectric effect. In other embodiments, at least a portion of the shell's interior surface may include a coating between the shell and the at least one of the plurality of FAEs. The coating may have a lower coefficient of friction than the shell's interior surface to increase a reaction time of the disc spring. Additionally, in each of FIGS. 21, 22, and 23, corresponding force sensing film elements 2104, 2206, or 2306 are separately shown.

Figure 20:
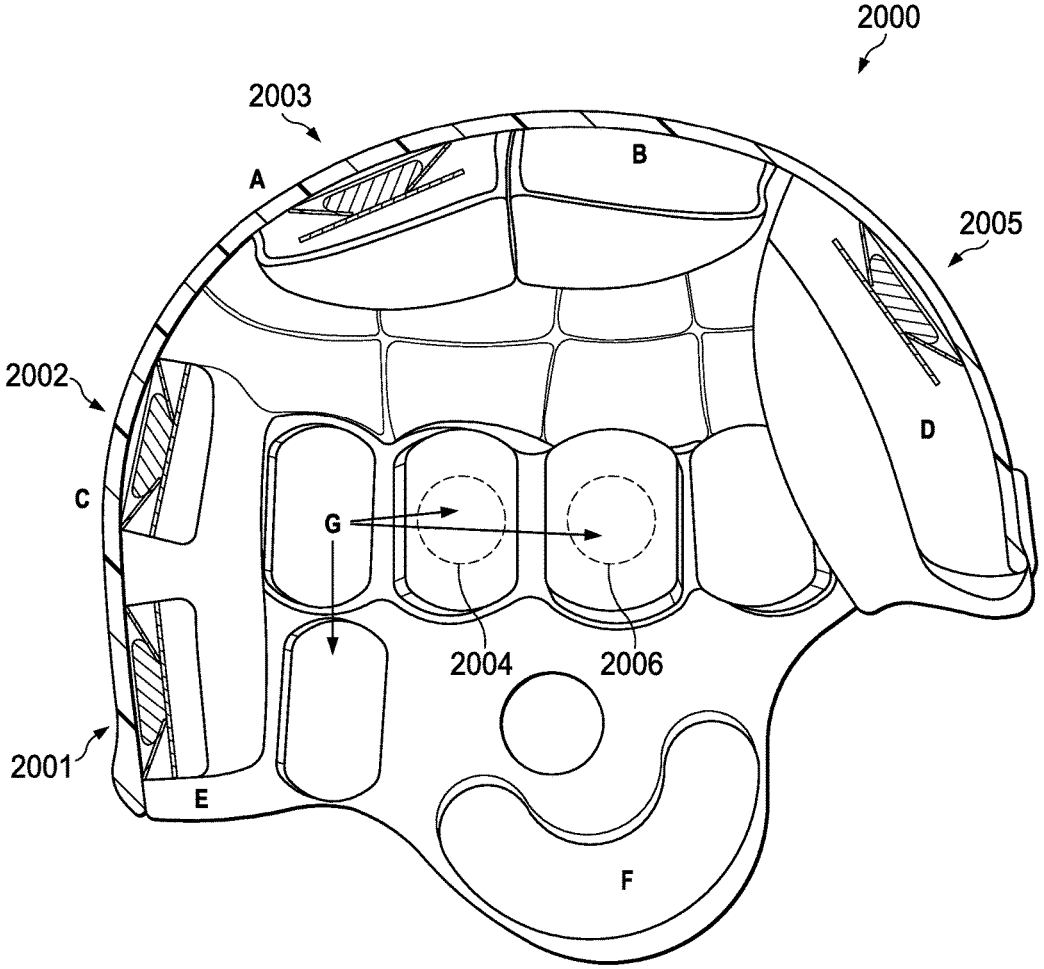
FIGS. 20-23 show schematic perspective or cross-sectional views of alternative embodiments of a helmet employing force-absorbing elements in accordance with at least one of the various embodiments.

In FIG. 20, helmet 2000 may include FAEs 2001-2006, which may be positioned in a front, rear, top, or side of the helmet. FAEs 2001-2006 may be embodiments of FAEs described herein. These FAEs may be affixed or otherwise positioned adjacent to the inside of the exterior shell of the helmet. Reference letters A-F may represent various main common points of contact for impact forces to be applied to the helmet during a sporting event.

Figure 21:
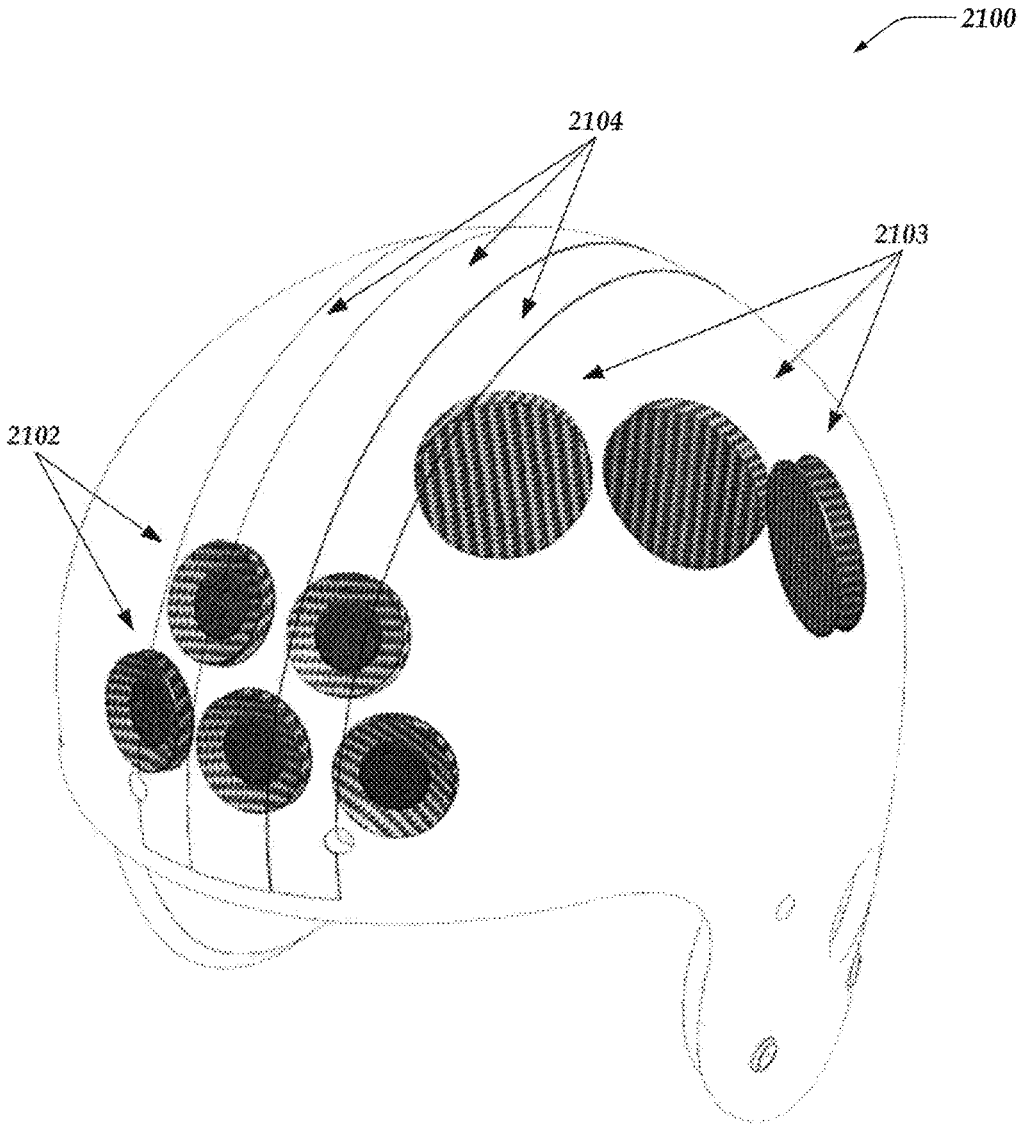

In FIG. 21, helmet 2100 may include FAEs 2102-2103. FAEs 2102-2103 may be embodiments of FAEs described herein. In this arrangement, there may be five FAEs positioned in the front of the helmet (e.g., adjacent to a wearer's forehead) and three FAEs positioned in the rear of the helmet (e.g., adjacent to a wearer's back of the head). In some embodiments, one or more of the plurality of FAEs may have different capabilities and/or characteristics (e.g., load-deflection profile) than another one or more of the plurality of FAEs. For example, FAEs 2102 may have a smaller diameter of FAEs 2103 may have a smaller load capacity than FAEs 2103. However, embodiments are not so limited and other arrangements of same or different FAEs may be employed.

In various embodiments, one or more of the FAEs may include a force sensing film. In some embodiments, the film may change colors based on the force applied to the film. For example, the film may change from green to red if more than a minimum threshold force is applied to the film, and so the FAE. Similarly, the film may have varying colors depending on the force applied to the film. For example, one FAE may include a plurality of force-sensing-film rings where each ring changes color based on a different amount of force. In this way, a user can determine how large the force was that was received. Such an embodiment can help coaches and doctors determine if a wearer may have been subject to an impact that was large enough to cause a concussion. So, for example, if a football player receives a large hit on the field, a doctor can remove the FAE and look at the force sensing film to determine the level of force taken during the hit. And if the force is high enough, the player may be removed from the game to limit or prevent additional brain trauma.

Similarly, other force sensing devices may be employed. For example, one or more of the FAEs may include a piezoelectric sensor that when compressed due to an impact force on the FAE, the piezoelectric sensor may cause one or more LEDs built into the helmet to become activated and emit light. The use of piezoelectric sensors and LEDs may enable a user to identify if an impact was high enough to cause physical trauma. It should be noted, that the threshold for activating an LED or activating a force sensing film to change colors may be designed based on a minimum load known to cause trauma in a wearer (which may change based on the activity, positioning on the body, age or gender of the wearer, or the like).

Figure 22:
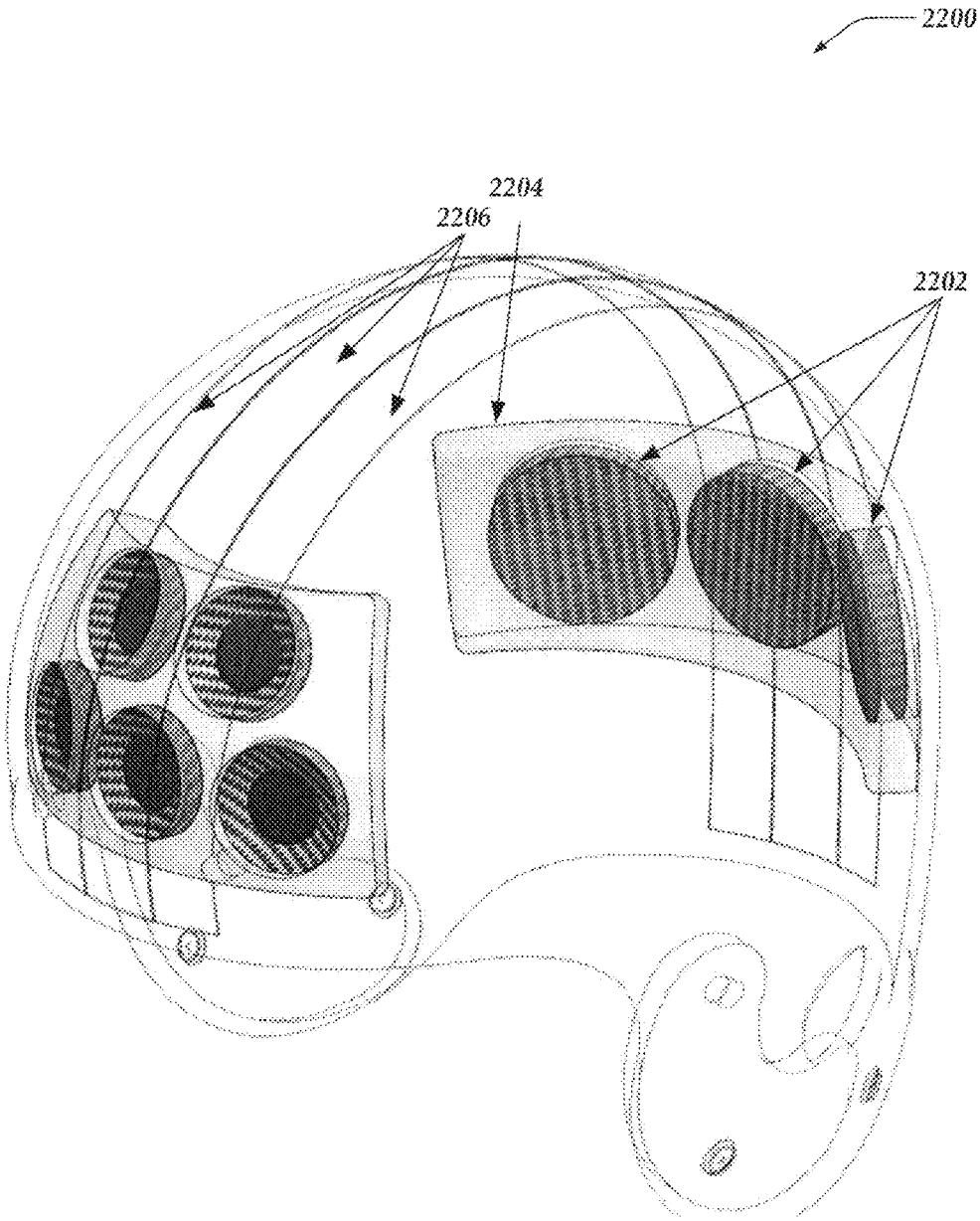

Helmet 2200 of FIG. 22 illustrates embodiments where one or more FAEs (e.g., FAEs 2202) may be embedded or otherwise partially enclosed in the foam cushion (e.g., cushion 2204) of the helmet. In some embodiments, cushions in typical helmets may be removed, and the hybrid cushion FAE may be installed into the helmet (e.g., by use of hook and loop connectors.

Figure 23:
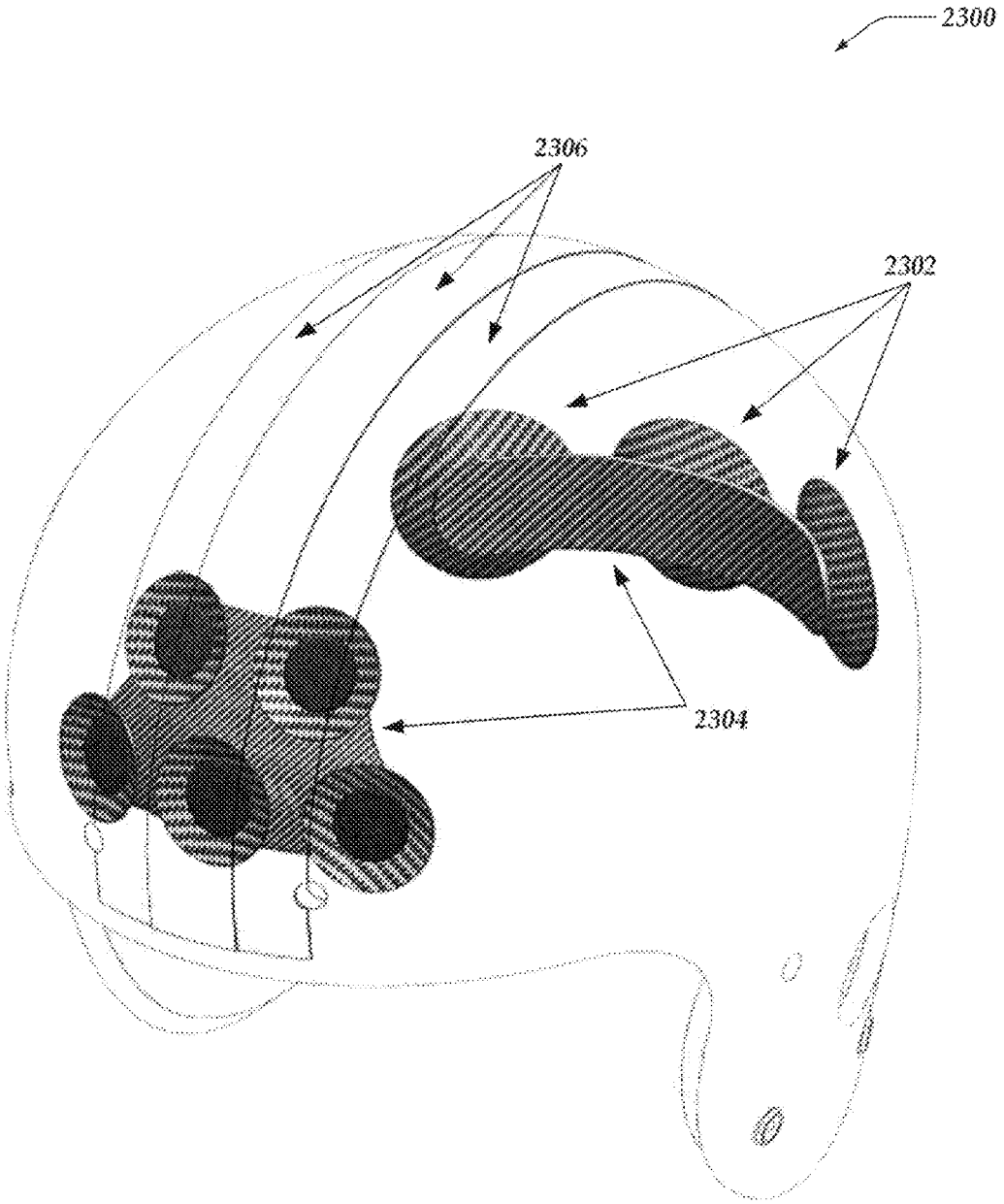

FIG. 23 illustrates helmet 2300 with a plurality of FAEs, similar to embodiments illustrated in FIG. 21. Helmet 2300 may also include rigid component 2304. Rigid component 2304 may be a backing that can provide a rigid surface for the FAEs (e.g., FAEs 2302) to compress against when an impact force is applied to the outside of the helmet. In some embodiments, the rigid backing may be planar or concave, similar to the curvature of the shell. In other embodiments, the rigid component may be flat or otherwise smooth so that a disc spring of the FAE can slide along the rigid component while the disc is compressing due to an applied force.

In some embodiments, some individual FAE may have a separate rigid component. While in other embodiments, a plurality of FAEs may share a one or more rigid components. In various embodiments, the FAEs and rigid components may be embedded in the foam cushion, similar to that illustrated in FIG. 22. In at least one of various embodiments, one or more FAEs may be sandwiched between two rigid components in one or more foam cushions. For example, a cushion may include one or more FAEs. Each of these FAEs may be sandwiched between separate rigid components. In this way, the FAEs may engage the rigid components (when compressed due to a force applied to the helmet) rather than helmet shell. In some embodiments, cushion may be removable from the helmet. In various embodiments, a layer of foam cushion may be between rigid component 2304 and a wearer's head, which is illustrated in FIG. 24.

Figure 24:
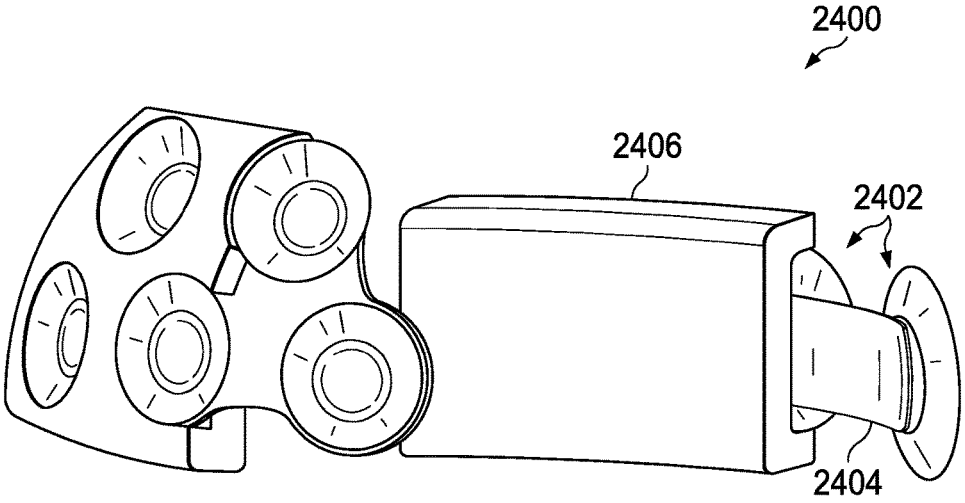
FIG. 24 shows a schematic perspective view of an embodiment of a partial foam pad with force-absorbing elements in accordance with at least one of the various embodiments.

FIG. 24 shows a schematic perspective view of an embodiment of a partial foam pad with force-absorbing elements in accordance with at least one of the various embodiments. As described herein, one or more FAEs (e.g., FAEs 2402) and a rigid component (e.g., rigid component 2404) may be embedded, partially enclosed, or otherwise built into a foam cushion (e.g., cushion 2406).

Figure 25A:
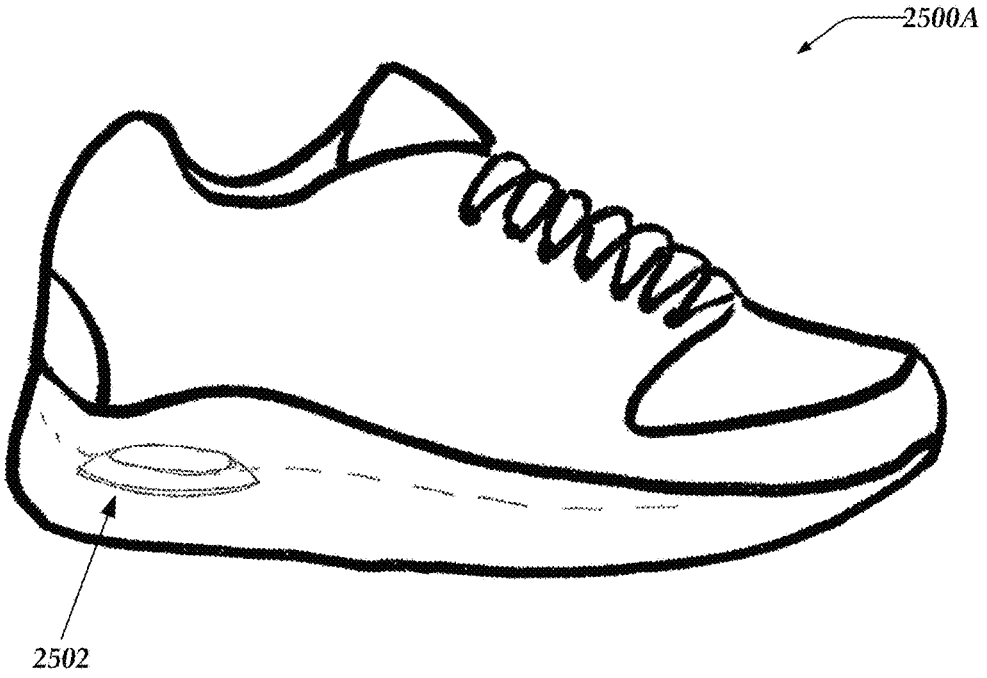
FIGS. 25A-25B show schematic views of an embodiment of a shoe utilizing force-absorbing elements in accordance with at least one of the various embodiments.
Figure 25B:
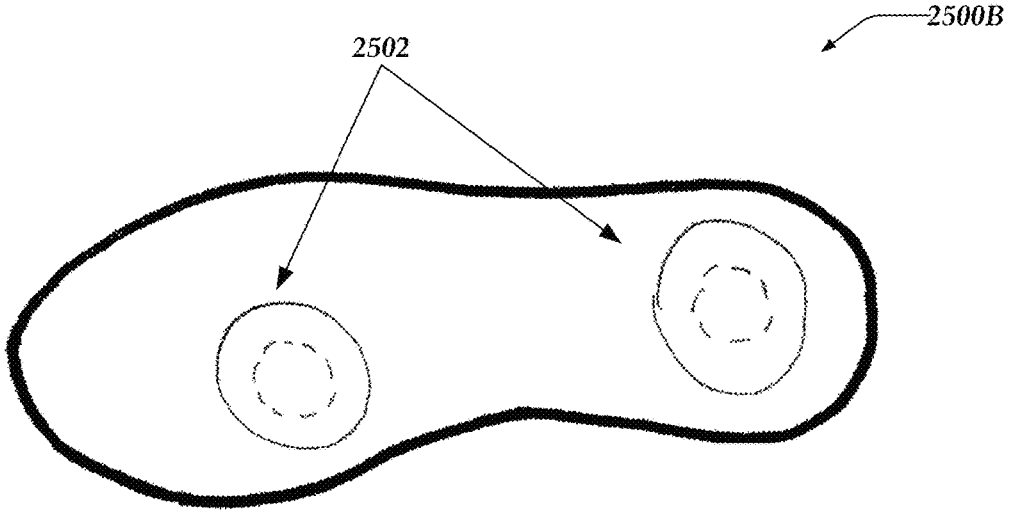

FIGS. 25A-25B show schematic views of an embodiment of a shoe utilizing force-absorbing elements in accordance with at least one of the various embodiments. Shoes 2500A-2500B may include one or more FAEs 2502 in the sole of the shoe. The FAE could be placed in one or more locations of the shoe for improved comfort, as well as for a desired improvement in the "spring effect" of the shoe, especially in athletic shoes. In various embodiments, an FAE may be positioned to be beneath a wearer's heel. In other embodiments, an FAE may be positioned to be beneath a wearer's "ball of the foot." These positions may vary depending on the style or type of shoe, who is the shoe designed for, or the like.

In some embodiments, the FAE may be positioned between the shoe insole and shoe's more rigid base. In other embodiments, the FAE may be molded into a cavity in the rigid base of the shoe (similar to the embedded FAE and cushion of the helmet.

Figure 26A:
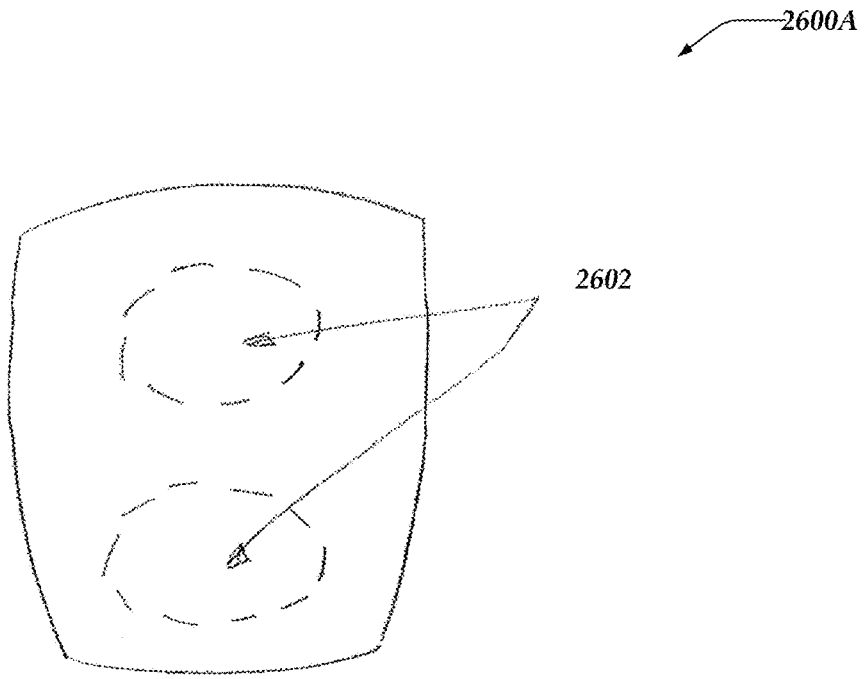
FIGS. 26A-26B show schematic views of an embodiment of a protective pad utilizing force-absorbing elements in accordance with at least one of the various embodiments.
Figure 26B:
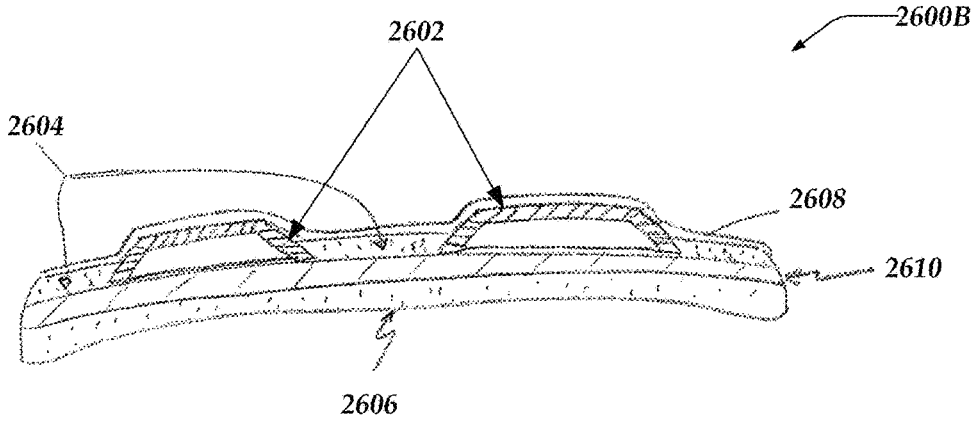

FIGS. 26A-26B show schematic views of an embodiment of a protective pad utilizing force-absorbing elements in accordance with at least one of the various embodiments. Protective pad 2600A may include one or more FAEs 2602. Due to the compact size and light weight of FAEs, the use of FAEs could be readily incorporated in various types of protective clothing, padding, shields, or the like with little additional weight. For example, one or more FAEs could be utilized to improve the impact protection performance of body padding and gear. Examples of such gear that may utilized FAEs may include, shin guards, forearm pads, elbow pads, knee pads, thigh pads, chest pads, and other types of padding used in football, hockey, baseball, mountain biking, motorcycling, or other sporting activities. Similarly, police and military protection gear designed to absorb force impacts may also employ FAEs.

Protective pad 2600B of FIG. 26B may be an embodiment of protective pad 2600A. Protective pad 2600 may include FAEs 2602, flexible foam 2604, foam padding 2606, rigid liner 2608, and rigid base 2610. Flexible foam 2604 may surround FAEs 2604. While an FAE flexes to absorb an impact force, the FAE may compress flexible foam 2604. Flexible foam 2604 may provide additional force absorbing properties along with the FAEs. Foam padding 2606 may be a backing that can provide comfort for a wearer of the protective pad. Rigid liner 2608 may provide a cavity for the FAEs to flex/deflect while absorbing an impact force. Rigid base 2610 may be provide a rigid surface for the FAEs to compress against, which can allow them to deflect and absorb an impact force. Rigid liner 2608 and rigid base 2610 may be on opposite sides of the FAEs.

Figure 27A:
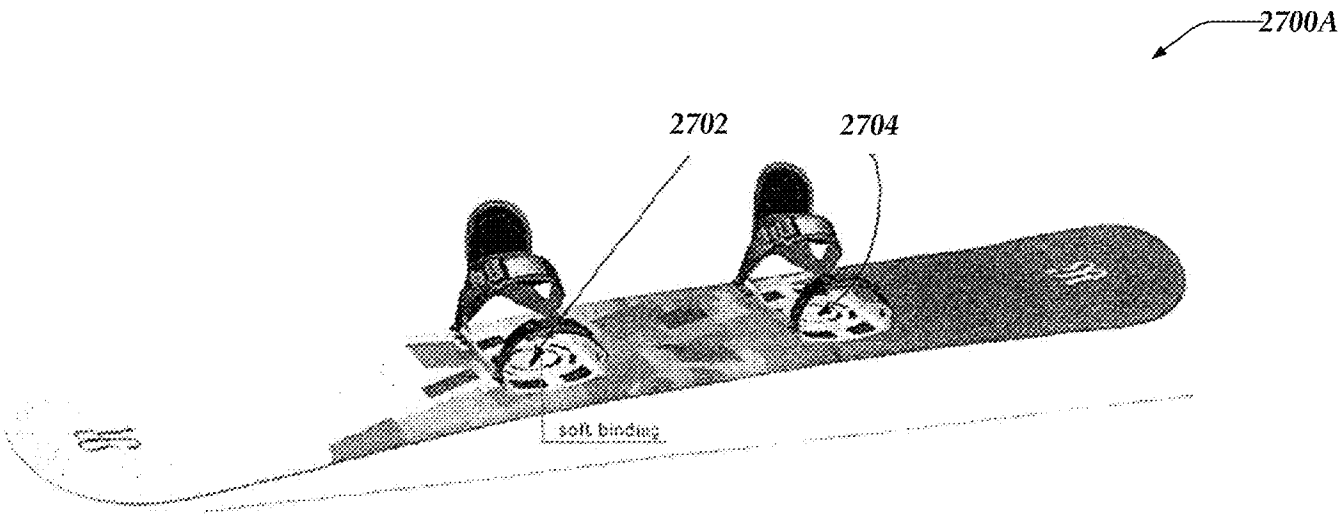
FIGS. 27A-27B show schematic views of an embodiment of a snowboard utilizing force-absorbing elements in accordance with at least one of the various embodiments.
Figure 27B:
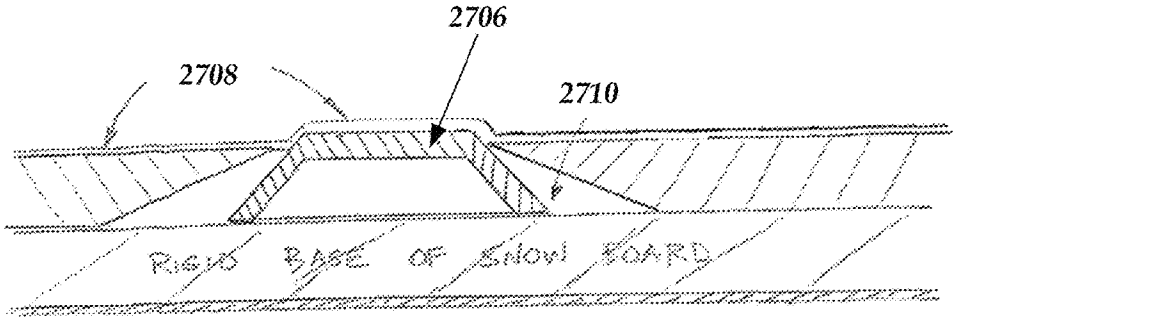

FIGS. 27A-27B show schematic views of an embodiment of a snowboard utilizing force-absorbing elements in accordance with at least one of the various embodiments. Improvements in shock and vibration dampening can be useful in snow boards, skate boards, skis, and other planar sporting equipment. Due to the small envelope of space in these types of equipment, an FAE incorporated within the construction of the planar structures.

For example, snowboard 2700A may include FAEs 2702 and 2704 under a soft binding. The soft binding may be a binding with a base that can flex or compress (e.g., exterior liner 2708 in FIG. 27B). In that way, a boot may press against the soft binding and thus the FAEs. The FAEs may be designed to accommodate a rider's weight, but can flex and absorb impact as a rider is using the snowboard.

As shown in FIG. 27B, snowboard 2700B may include FAE 2706 between exterior liner 2708 and the rigid base of the snowboard. In some embodiments, exterior liner 2708 may be a flexible cover of a soft binding. In various embodiments, the FAE may be fabricated into a cavity (e.g., cavity 2710) inside the board or ski with the FAE slightly raised relative to the top surface of the board to make positive contact with the boot or shoe of the rider. FAE 2706 may be surrounding, horizontal to the symmetrical center axis of the FAE, in 360 degrees by cavity 2710. Cavity 2710 may be larger than the outer diameter of the circular FAE to allow room for maximum flex during compression of the FAE when subjected to impact loads and strong vibrations.

Figure 28A:
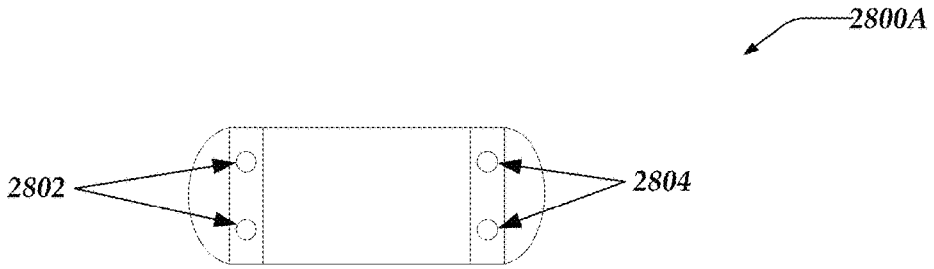
FIGS. 28A-28D show schematic views of an embodiment of a skateboard utilizing force-absorbing elements in accordance with at least one of the various embodiments.

Similar structure and arrangement may be employed in skis and other planar sporting equipment, where the boot, shoe, or foot can engage the FAE. In another example, FIGS. 28A-27D show schematic views of an embodiment of a skateboard utilizing force-absorbing elements in accordance with at least one of the various embodiments. Skateboard 2800A may include a plurality of FAEs as described herein. These FAEs may be positioned over the trucks to provide additional shock absorbing functionality. As shown in FIG. 28, skateboard 2800B may include FAEs 2806 and 2810 (which may be FAEs 2802 or FAEs 2804 of FIG. 28A) above truck 2818. FAEs 2806 may be positioned between a top board 2810 and a bottom board 2812. In this illustration, bottom board 2812 may move vertically within the confines of edges 2814 and 2816 when FAEs 2806 flex due to an impact force exerted by truck 2818 (through the wheels) or by a rider through top board 2810.

Figure 28B:
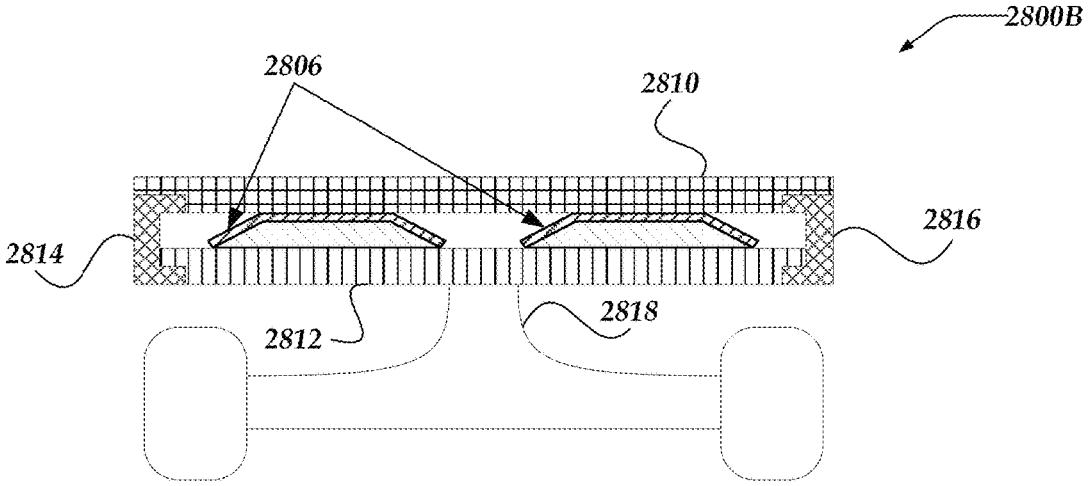
Figure 28C:
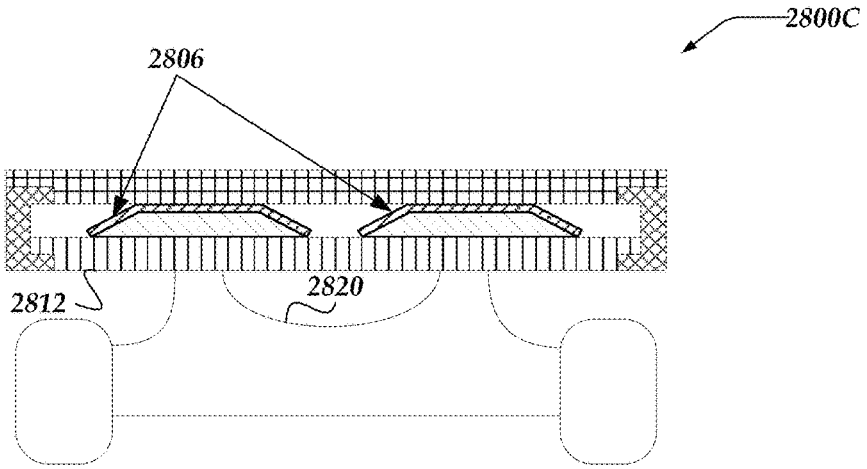
Figure 28D:
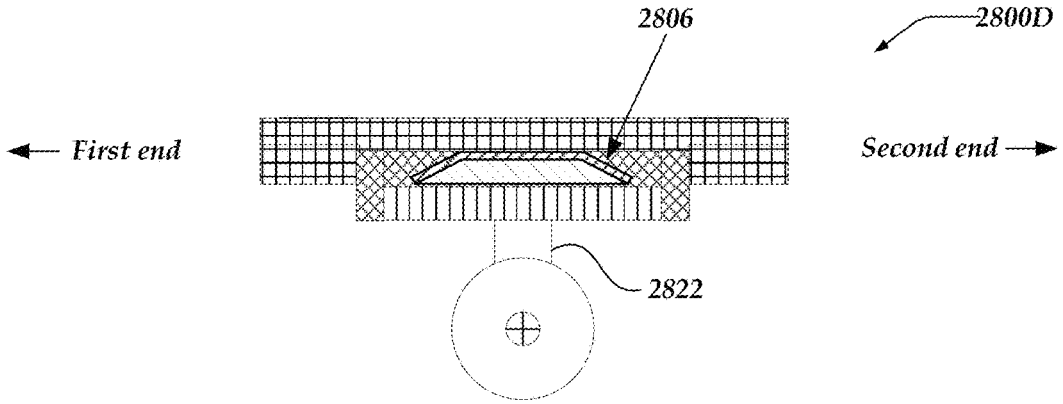

Skateboard 2800C of FIG. 28C may be an alternative of skateboard 2800B of FIG. 28B. In this embodiment, truck 2820 may include two stems that connect to bottom board 2812 centrally located below FAEs 2806. FIG. 28D illustrates a side, cross-sectional view of skateboard 2800D, with truck 2822 centered below FAE 2806. Truck 2822 may be an embodiment of truck 2820 of FIG. 28C or truck 2818 of FIG. 28B.

What is claimed is:

1. A helmet adapted for use by a human being, comprising:

a shell configured and arranged to cover at least a portion of a wearer's head, the shell having an exterior surface and an interior surface;

a plurality of force-absorbing elements that are separately positioned adjacent to the shell's interior surface, wherein each force-absorbing element of the plurality of force-absorbing elements includes:

at least one disc spring having a frusto-conical exterior with a planar top surface and a skirt extending from the planar top surface to an edge defining an aperture, a diameter of the planar top surface being smaller than a diameter of the aperture defined by the edge to absorb forces by deforming along the at least one disc spring's central, symmetrical axis; and an elastomeric component having a body and an end, the body being positioned in a second aperture that passes through the planar top surface and a bottom plane of the at least one disc spring, wherein a portion of the end of the elastomeric component has a diameter that is larger than a diameter of the body and a diameter of the second aperture; and at least one rigid component that is disposed within the shell and adjacent to the plurality of force-absorbing elements, the rigid component having an outer surface, wherein the plurality of force-absorbing elements are between the shell's interior surface and the at least one rigid component, and one of the planar top surface and the edge is in contact with the shell's interior surface and the other of the planar top surface and the edge is in contact with the outer surface of the at least one rigid component, and wherein a force applied to a location on the shell's exterior surface is substantially absorbed by at least one force-absorbing element of the plurality of force-absorbing elements separately positioned adjacent to the location on the shell's interior surface, and wherein the at least one disc spring of the at least one force-absorbing element is configured to deform by reducing a distance between the planar top surface and the edge, wherein the diameter of the aperture increases as the at least one disc spring deforms and the edge slides along the surface with which the edge is in contact.

2. A force absorption system adapted for use in a helmet for a human being, comprising:

a plurality of force-absorbing elements, wherein each force-absorbing element of the plurality of force-absorbing elements includes at least one disc spring having a frusto-conical exterior with a planar top surface, a skirt extending from the planar top surface to an edge defining an aperture, a diameter of the planar top surface being smaller than a diameter of the aperture defined by the edge to absorb forces by deforming along the at least one disc spring's central, symmetrical axis;

at least one rigid component having an outer surface that is positioned in contact with one of the planar top surface and the edge of each force-absorbing element of the plurality of force-absorbing elements, and wherein the other of the planar top surface and the edge of each force-absorbing element of the plurality of force-absorbing elements is in contact with an interior surface of the helmet; and a component that at least partially encloses each force-absorbing element of the plurality of force-absorbing elements and the at least one rigid component, wherein the component is configured to removably mount each force-absorbing element of the plurality of force-absorbing elements to a separate position on the interior surface of the helmet, such that when a force is applied to a location on an exterior surface of the helmet, the force is substantially absorbed by at least one force-absorbing element of the plurality of force-absorbing elements, wherein the at least one disc spring of the at least one force-absorbing element is configured to deform by reducing a distance between the planar top surface and the edge, wherein the diameter of the aperture increases as the at least one disc spring deforms and the edge slides along the surface with which the edge is in contact.

3. The system of claim 2, wherein the at least one force-absorbing element of the plurality of force-absorbing elements includes a force sensing film that changes color or exhibits piezoelectricity when a predetermined amount of force is applied to the at least one force-absorbing element.

4. The system of claim 2, wherein each force-absorbing element of the plurality of force-absorbing elements further includes:

an elastomeric component having a body and an end, the body being positioned in a second aperture that passes through the planar top surface and a bottom plane of the at least one disc spring, wherein a portion of the end of the elastomeric component has a diameter that is larger than a diameter of the cylindrical body and a diameter of the second aperture.

5. The system of claim 2, wherein at least a portion of the interior surface of the helmet or the at least one rigid component includes a coating having a lower coefficient of friction than the rigid component or the interior surface of the helmet.

6. The system of claim 2, wherein the planar top surface of the at least one disc spring comprises one of a plate, an aperture, and a plate with an aperture.

* * * * *